US010334953B2

(12) United States Patent
Masunaga et al.

(10) Patent No.: US 10,334,953 B2
(45) Date of Patent: Jul. 2, 2019

(54) FURNITURE, LOAD SUPPORT MEMBER FOR CHAIR, AND CHAIR

(71) Applicant: OKAMURA CORPORATION, Yokohama-shi, Kanagawa (JP)

(72) Inventors: Hiroshi Masunaga, Yokohama (JP); Yoshinori Isogai, Yokohama (JP); Kouichirou Wakizono, Yokohama (JP); Naoyuki Okuda, Yokohama (JP); Syouichi Izawa, Yokohama (JP)

(73) Assignee: OKAMURA CORPORATION, Kanagawa (JP)

( * ) Notice: Subject to any disclaimer, the term of this patent is extended or adjusted under 35 U.S.C. 154(b) by 0 days.

(21) Appl. No.: 15/520,678

(22) PCT Filed: Oct. 23, 2015

(86) PCT No.: PCT/JP2015/079953
§ 371 (c)(1),
(2) Date: Apr. 20, 2017

(87) PCT Pub. No.: WO2016/063973
PCT Pub. Date: Apr. 28, 2016

(65) Prior Publication Data

US 2017/0311724 A1 Nov. 2, 2017

(30) Foreign Application Priority Data

Oct. 24, 2014 (JP) ..... 2014-217249
Oct. 30, 2014 (JP) ..... 2014-221256
Jan. 16, 2015 (JP) ..... 2015-006732

(51) Int. Cl.
*A47C 7/28* (2006.01)
*A47C 7/40* (2006.01)

(52) U.S. Cl.
CPC ..... *A47C 7/40* (2013.01); *A47C 7/282* (2013.01)

(58) Field of Classification Search
CPC ..... A47C 7/282
See application file for complete search history.

(56) References Cited

U.S. PATENT DOCUMENTS 4,761,035 A 8/1988 Urai
4,883,320 A 11/1989 Izumida et al.
(Continued)

FOREIGN PATENT DOCUMENTS

DE 20216302 4/2003
JP 57-137353 8/1982
(Continued)

OTHER PUBLICATIONS

International Search Report dated Jan. 26, 2016 of the PCT Patent Application No. PCT/JP2015/079953.
(Continued)

*Primary Examiner* — Timothy J Brindley
(74) *Attorney, Agent, or Firm* — Nixon Peabody LLP; Jeffrey L. Costellia

(57) ABSTRACT

Furniture and a chair include a shielding piece (**7*b*5) which is provided in an operation plate (7*b*2) or a flange (7*a*5) and closes a gap generated by the operation plate (7*b*2) and the flange (7*a*5) when the operation plate (7*b*2) has an operation posture. In addition, a chair includes a load support member for a chair, the load support member for a chair includes a frame member which includes a pair of rod members (19) and an extension material (22) which is formed in a bag shape and covers the frame member, a support portion (26) is provided on each of inner surfaces facing each other in the pair of rod members (19), and an interior material (21**) having a repulsive force with respect to a load in a surface
(Continued)

perpendicular direction is bridged between the pair of rod members (19) by being supported by the support portion (26).

10 Claims, 18 Drawing Sheets

(56) References Cited

U.S. PATENT DOCUMENTS

| | | | | |
|---|---|---|---|---|
| 6,050,646 | A * | 4/2000 | Stenzel | A47C 5/06 297/218.3 |
| 6,074,013 | A * | 6/2000 | Hsiao | A47C 5/06 297/440.1 |
| D673,394 | S * | 1/2013 | Hurford | D6/716 |
| 9,179,778 | B2 * | 11/2015 | Frankel | A47C 4/28 |
| 9,204,726 | B2 * | 12/2015 | Tseng | A47C 4/44 |
| 2002/0074839 | A1 | 6/2002 | Mahan | |
| 2002/0117885 | A1 * | 8/2002 | Barile, Jr. | A47C 7/282 297/452.52 |
| 2003/0209935 | A1 * | 11/2003 | Legal | A47C 5/06 297/452.63 |
| 2004/0245841 | A1 * | 12/2004 | Peterson | A47C 7/28 297/452.63 |
| 2006/0202534 | A1 * | 9/2006 | Heidmann | A47C 7/405 297/354.1 |
| 2007/0102987 | A1 * | 5/2007 | Chen | A47C 7/282 297/452.56 |
| 2008/0122285 | A1 * | 5/2008 | Lin | A47C 7/282 297/452.56 |
| 2009/0302662 | A1 * | 12/2009 | Groelsma | A47C 7/282 297/452.18 |
| 2010/0001572 | A1 * | 1/2010 | Masunaga | A47C 7/282 297/452.29 |
| 2010/0264708 | A1 * | 10/2010 | Rajaratnam | A47C 1/022 297/284.2 |
| 2011/0204694 | A1 | 8/2011 | Igarashi et al. | |
| 2013/0187424 | A1 | 7/2013 | Pleskot | |

FOREIGN PATENT DOCUMENTS

| | | |
|---|---|---|
| JP | 61-184448 | 11/1986 |
| JP | 64-014053 | 1/1989 |
| JP | 2002119355 A | 4/2002 |
| JP | 2006-069330 | 3/2006 |
| JP | 2006-122079 | 5/2006 |
| JP | 2006-122399 | 5/2006 |
| JP | 4061167 B | 3/2008 |
| JP | 2012-010868 A1 | 1/2012 |
| JP | 2013-094596 | 5/2013 |
| JP | 2013-124065 | 6/2013 |
| JP | 2013198565 A | 10/2013 |
| WO | 2010050204 A1 | 5/2010 |
| WO | WO-2011-122286 | 10/2011 |

OTHER PUBLICATIONS

Extended European Search Report issued in European Patent Application No. 15853321.6 dated Apr. 13, 2018.

Japanese Office Action issued in Japanese Applicaiton No. 2014-221256 dated Dec. 11, 2018, with English translation.

Japanese Office Action for Application No. 2015-006732 dated Feb. 19, 2019.

* cited by examiner

FURNITURE, LOAD SUPPORT MEMBER FOR CHAIR, AND CHAIR

TECHNICAL FIELD

The present invention relates to furniture, a load support member for a chair, and a chair.

Priority is claimed on Japanese Patent Application No. 2014-221256, filed on Oct. 30, 2014, Japanese Patent Application No. 2014-217249, filed on Oct. 24, 2014, and Japanese Patent Application No. 2015-006732, filed on Jan. 16, 2015, the contents of which are incorporated herein by reference.

BACKGROUND ART

For example, in a chair which is used in an office or the like, there is a chair in which a seat surface height can be adjusted or strength of locking can be adjusted. An operation member for performing the adjustments is provided in this chair, and for example, a seated person can perform various adjustments by changing a posture of the operation member (for example, refer to Patent Document 1).

Meanwhile, for example, Patent Document 2 discloses a load support member for a chair in which an extension material having an elastic resistance force (repulsive force) with respect to a load in a surface perpendicular direction is supported by a frame member which is a strength member, and a chair having the load support member for a chair. In the chair disclosed in Patent Document 2, high tension in an up-down direction is secured by a group of warps configuring a structure of the extension material, and a stretching force in a right-left direction is secured by a group of wefts configured of chenille yarn and elastic yarn.

The chair disclosed in Patent Document 2 has a satisfactory seating feeling in which an appropriate elastic resistance and expansion and contraction are compatible. On the other hand, since a group of warps is indispensable in order to maintain a minimum strength and wefts extending in the right-left direction are added to obtain the stretching force, it tends to be a design in which a large number of dot-shaped gaps are formed between the warps and the wefts due to the extensions, and even though the warps and wefts are members which effect the appearance, the degree of freedom in terms of design is likely to decrease.

In order to solve the problems, a configuration disclosed in Patent Document 3 is considered. In a chair disclosed in Patent Document 3, two grooves having directions different from each other are formed in a rod member, extension materials different from each other are fastened to the respective grooves, and a plurality of extension materials extend in a frame member.

According to this configuration, for example, an irregular design in which an element having strong tension is adopted as a rear surface side extension material and an element having weak tension is adopted as a front surface side extension material is possible, and the degree of freedom in terms of design increases.

CITATION LIST

Patent Document

[Patent Document 1] Japanese Unexamined Patent Application, First Publication No. 2002-119355

[Patent Document 2] Japanese Patent No. 4061167

[Patent Document 3] Japanese Unexamined Patent Application, First Publication No. 2013-198565

SUMMARY OF INVENTION

Technical Problem

In the chairs having the above-described operation members, a member which is smoothly connected to the operation member in appearance may be disposed to be adjacent to the operation member in order to have a sense of unity and an aesthetic appearance or the operation member is disposed to be adjacent in order to improve operability. That is, in the chair having the operation member, other members (adjacent member) may be provided to be adjacent to the operation member. In this case, if the operation member in which the adjacent member is provided moves to change a posture of the operation member, a gap between the operation member and the adjacent member may occur. If a finger of a user on the chair is inserted into the gap, when the posture of the operation member is returned to the original posture, the user' finger interposed between the operation member and the adjacent member. In general, a biasing force for returning the operation member to the original posture is set to be weak, and it is designed such that the user's finger is not hurt. However, if the finger is interposed between the operation member and the adjacent member, it discomforts the user.

In addition, this problem is not limited to the chair, and occurs in the whole furniture having an operation member in which the posture is changed such as a desk in which the height of a top plate can be adjusted.

Meanwhile, in the configuration disclosed in Patent Document 3, since the plurality of grooves are formed on the frame member in different directions, and there is problem that a shape of the frame member and a shape of a mold forming the frame member are complicated.

The present invention is made in consideration of the above-described problems, and an object thereof is to prevent discomforting a user due to a user's finger being interposed in a gap between an operation member and an adjacent member disposed to adjacent to the operation member in furniture having the operation member in which the posture is changed.

In addition, another object of the present invention is to provide a load support member for a chair in which a plurality of extension materials can be supported without complicating a shape of a frame member and a degree of freedom in terms of design of the extension material increases, and a chair having the same.

Solution to Problem

The present invention adopts the following configurations as means for achieving the above-described objects.

According to a first invention, there is provided furniture which includes an operation member which is changed from a normal posture to an operation posture by an operation of a user and an adjacent member which is disposed to be adjacent to the operation member, and the furniture includes a shielding portion which is provided in the operation member or the adjacent member and closes a gap generated by the operation member and the adjacent member when the operation member has the operation posture.

According to this configuration, the gap generated by the operation member and the adjacent member when the operation member has the operation posture is closed by the shielding portion. Accordingly, it is possible to prevent a user's finger from being interposed between the operation member and the adjacent member, and it is possible to prevent discomforting the user.

According to a second invention, in the first invention, the operation member includes a pivot which extends in a horizontal direction and an operation plate which has a plate shape in which front and rear surfaces face upward and downward and has the operation posture by raising the tip side about the pivot, and the adjacent member includes a flange which is disposed so as to be the same height as that of the operation plate in the operation member having the normal posture and in which front and rear surfaces face upward and downward.

According to this configuration, since the operation plate included in the operation member and the flange included in the adjacent member are arranged to be the same height as each other in the case where the operation member has the normal posture, a sense of unity of the operation member and the adjacent member increases, and an aesthetic appearance is obtained. Meanwhile, since the tip of the operation plate moves upward and downward and the posture of the operation member is changed, a gap is easily generated between the operation plate and the flange. With respect to this, since this configuration includes the shielding portion, even in furniture having favorable sense of unity, it is possible to prevent a user's finger from being interposed between the operation member and the adjacent member, and it is possible to prevent discomforting the user.

According to a third invention, in the second invention, the shielding portion is configured of a shielding piece which protrudes downward from the edge portion on the flange side of the operation plate and is provided such that front and rear surfaces face in an arrangement direction between the operation member and the adjacent member.

According to this configuration, since the operation plate and the shielding piece are provided to be integrated, it is possible to provide the shielding portion without increasing the number of parts. In addition, in a case where the operation plate is viewed from above, the shielding piece is not easily viewed in appearance, and the aesthetic appearance is not damaged by the shielding piece.

According to a fourth invention, in the third invention, the shielding piece includes an inclined side which faces downward from the inner side of the operation plate toward the tip side.

For example, in a case where the operation plate is disposed at a position which is not easily viewed from a user, a user' fingertip is likely to be hooked to a root of the operation plate. Since the root of the operation plate is close to the pivot, it is necessary to operate the operation plate by a very strong force in a case where the posture of the operation plate is changed in a state where the fingertip is hooked to the root of the operation plate, and the user is likely to feel deterioration of operability. Meanwhile, according to this configuration, the shielding piece includes the inclined side which faces downward from the inner side of the operation plate toward the tip side. Accordingly, if a great force is applied to the inner side (that is, the root side) of the operation plate, a user's fingertip easily moves toward the tip side of the operation plate along the inclined side of the shielding piece which is provided on the edge portion of the operation plate, and it is possible to guide the user's fingertip to the tip side of the operation plate at which the operation is easily performed by the user's fingertip without awareness of the user. Therefore, according to this configuration, it is possible to operate the operation member with a weak force, and excellent operability is obtained.

According to a fifth invention, in any one of the second to fourth inventions, the operation member includes a connection portion which connects the operation plate and the pivot to each other and a protrusion portion which is provided on a lower surface of the connection portion.

According to this configuration, since the connection portion is provided, it is possible to provide the operation plate so as to be further separated from the pivot, and it is possible to operate the operation plate with a weaker force. In addition, the protrusion portion is provided on the lower surface of the connection portion. Accordingly, even in a case where the operation plate is disposed at a position at which it is not easily viewed from a user, it is possible to prevent a user's fingertip from being hooked to the lower surface of the connection portion close to the pivot due to interference of the protrusion portion, and it is possible to guide the user's fingertip to the tip side of the operation plate which is more easily operated by the user's fingertip.

According to a sixth invention, in any one of the second to fifth inventions, a second operation member is provided, which has a lever moving along the upper surface of the flange and is rotatable by the lever which is moved by a user.

According to this configuration, since the operation member and the second operation member can be provided so as to be close to each other, it is possible to obtain excellent operability. In addition, according to this configuration, in the furniture in which excellent operability is obtained, it is possible to prevent a user's finger from being interposed between the operation member and the adjacent member.

According to a seventh invention, there is provided a chair which an operation member which is provided a side portion of a seat or below the seat and an adjacent member which is disposed to be adjacent to the operation member, and the furniture according to any one of the first to sixth inventions.

According to this configuration, a chair is provided in which a user' fingertip is prevented from being interposed between the operation member and the adjacent member and a user is not discomforted.

According to an eighth invention, there is provided a load support member for a chair which is included in a chair, including: a frame member which is a strength member which includes a pair of rod members which is separated from each other in a width direction of the chair and is disposed to be approximately parallel to each other; and an exterior material which includes a front extension material disposed on a load receiving surface side of the chair and a rear extension material disposed on a side opposite to the load receiving surface which are joined to each other on one end edge in a length direction of the rod member and both end edges in the width direction, the exterior material being formed in a bag shape having an opening portion continuous in the width direction on the other end edge side in the length direction and covering the frame member through the opening portion from one end side in the length direction of the frame member, in which a support portion is provided on each of inner surfaces facing each other of the pair of rod members, and an interior material having a repulsive force with respect to a load in a surface perpendicular direction is bridged between the pair of rod members by being supported by the support portion.

According to the load support member for a chair, separately from the exterior material which covers the frame member and in which the front extension material and the rear extension material are joined to each other to be formed in a bag shape, the interior material having a repulsive force with respect to the load in the surface perpendicular direction is bridged between the pair of rod members. Accordingly, for example, it is possible to appropriately select the material or the like of the exterior material by setting the strength of the interior material to a degree by which a load of a seated person can be supported, and it is possible to greatly increase the degree of freedom in terms of design. In addition, since the exterior material is supported to the frame member so as to be wound around the rod member by the own shape and tension, a dedicated support portion is not required, and it is possible to mold the frame member at a low cost without complicating the shape of the rod member. Moreover, since the support portion which is formed on the inner surface of the rod member is hidden by the exterior material, it is possible to prevent an appearance from deteriorating due to the support portion.

According to a ninth invention, in the load support member for a chair, the support portion includes a fitting recessed portion which is opened to the load receiving surface side.

According to this configuration, the support portion is the fitting recessed portion which is formed on the inner surface of each rod member and is opened to the load receiving surface side of the chair. Accordingly, when the shape of the rod member having the fitting recessed portion is manufactured, it is possible to easily mold the rod member by performing molding in a state where two molds are arranged in the surface perpendicular direction of the load receiving surface, and it is possible to mold the frame member at a lower cost.

According to a tenth invention, in the load support member for a chair, the support portion is configured of a support material which is disposed with a gap with respect to the rod member on the inner surface side of the rod member, and the gap between the rod member and the support material becomes the fitting recessed portion, and an end portion of the support material on the load receiving surface side is positioned to be closer to a side opposite to the load receiving surface side than an end portion of a portion forming the fitting recessed portion in the rod member on the load receiving surface side.

According to this configuration, since the end portion of the support material on the load receiving surface side is positioned to be closer to the side opposite to the load receiving surface side than the end portion on the load receiving surface side of the portion of the rod member in which the fitting recessed portion is formed, the position of the interior material is further offset to the rear surface side of the chair than the end portion on load receiving surface side of the rod member. Accordingly, since the interior material abut the front extension material of the extension material from the rear side, deformation of the extension material is prevented, and a more favorable appearance can be obtained.

According to an eleventh invention, in the load support member for a chair, a repulsive force of the exterior material with respect to the load in the surface perpendicular direction is relatively smaller than the repulsive force of the interior material with respect to the load in the surface perpendicular direction.

According to this configuration, since the repulsive force of the bag-shaped exterior material is smaller than the repulsive force of the interior material, the exterior material is relatively softer than the interior material (the elastic resistance force is smaller), and even when a load is applied to the exterior material due to a body weight of a seated person or the like, a friction resistance is not easily generated between the exterior material and the rod member. Moreover, since the exterior material is soft, the exterior material is in contact with the rod member without coming into close contact with the rod member. Accordingly, with respect to the load in the surface perpendicular direction, the exterior material is not rotated to the rod member, and occurrence of frictional noise is prevented or decreased. In addition, a force which supports a seated person' body is secured by the relatively hard interior material. However, since the interior material is bridged between the facing surfaces of the rod members, the interior material does not interfere with the bag-shaped exterior material.

According to a twelfth invention, in the load support member for a chair, a spacer surface material is disposed between the front extension material and the interior material, and a repulsive force of the spacer surface material with respect to the load in the surface perpendicular direction is relatively smaller than the repulsive force of the interior material with respect to the load in the surface perpendicular direction.

According to this configuration, the spacer surface material having a smaller repulsive force than that of the interior material is disposed between the front extension material and the interior material. Accordingly, when a body weight of a seated person is applied to the load support member for a chair via the front extension material, since the load support member for a chair supports the body weight of the seated person by the interior material in a state where bending of the spacer surface material is added to bending of the exterior material, the seated person further feels softness at the time of the seating as the bending of the spacer surface material is added, and more improved seating feeling is obtained. In addition, since the spacer surface material is interposed, the upper edge portion of the exterior material and the upper edge portion of the interior material do not easily directly abut each other, and even when the chair is continuously used over a long period, it is possible to prevent the upper edge portion of the exterior material from extending.

According to a thirteen invention, in the load support member for a chair, covering of the spacer surface material is continuously applied from a front surface side of the interior material to a front surface side of the rod member.

According to this configuration, since covering of the spacer surface material is continuously applied from the front surface side of the interior material to the front surface side of the rod member, the spacer surface material fills a portion between the interior material and the rod member, and there is almost no influence of a bump therebetween. Accordingly, there is no possibility of discomforting a back portion of a seated person due to a bump.

According to a fourteenth invention, in the load support member for a chair, the spacer surface material is integrally attached to a rear surface of the front extension material.

According to this configuration, since the spacer surface material is integrally attached to the rear surface of the front extension material, the spacer surface material is integrally attached to the front extension material in advance, and it is possible to easily perform an assembly process of covering the frame member with the exterior material so as to assemble the load support member for a chair without trouble.

According to a fifteenth invention, a chair includes the load support member for a chair as a backrest in which the rod member is disposed in an up-down direction and the opening portion is disposed on a lower end portion.

According this chair, it is possible to greatly increase a degree of freedom in terms of design, and it is possible to mold the frame member at a low cost without complicating the shape of the rod member.

Advantageous Effects of Invention

According to the present invention, since the gap generated by the operation member and the adjacent member when the operation member has the operation posture is closed by the shielding portion, it is possible to prevent a user's finger from being interposed between the operation member and the adjacent member, and it is possible to prevent discomforting the user.

In addition, according to the load support member of a chair of the present invention, it is possible to support the exterior material and the interior material by the frame member without complicating the shape of the frame member, and it is possible to increase the degree of freedom in terms of design.

Moreover, according to the chair of the present invention, it is possible to greatly increase the degree of freedom in terms of design, and it is possible to mold the frame member at a low cost without complicating the shape of the rod member.

DESCRIPTION OF EMBODIMENTS

Hereinafter, an embodiment of a chair according to the present invention will be described in detail with reference to the drawings. In addition, in descriptions below, a direction in which a front surface of a person who seats on a chair 1 in a normal posture faces is referred to as a "front" or a "front surface", and the opposite direction is referred to as a "rear side" or a "rear surface". In addition, with respect to "upper", "lower", "left", and "right", an upward direction of a person who seats on a chair in a normal posture is referred to as "upper", the opposite direction is referred to as "lower", a direction on the left side of the person who seats on the chair 1 in the normal posture is referred to "left", and the opposite direction is referred to as "right". That is, a vertical direction is referred to as an "up-down direction", and a horizontal direction is referred to as a "right-left direction".

Figure 1:
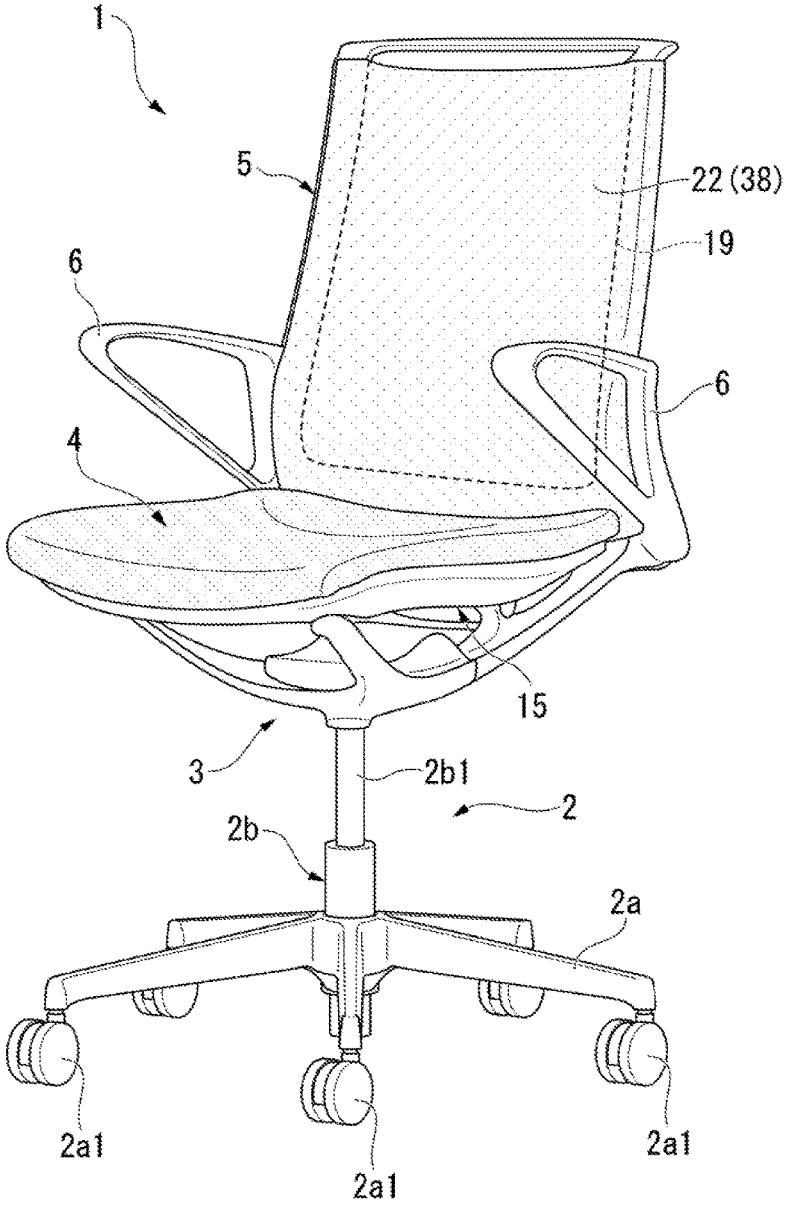
FIG. 1 is a perspective view when a chair according to an embodiment of the present invention is viewed from a front surface side.
Figure 2:
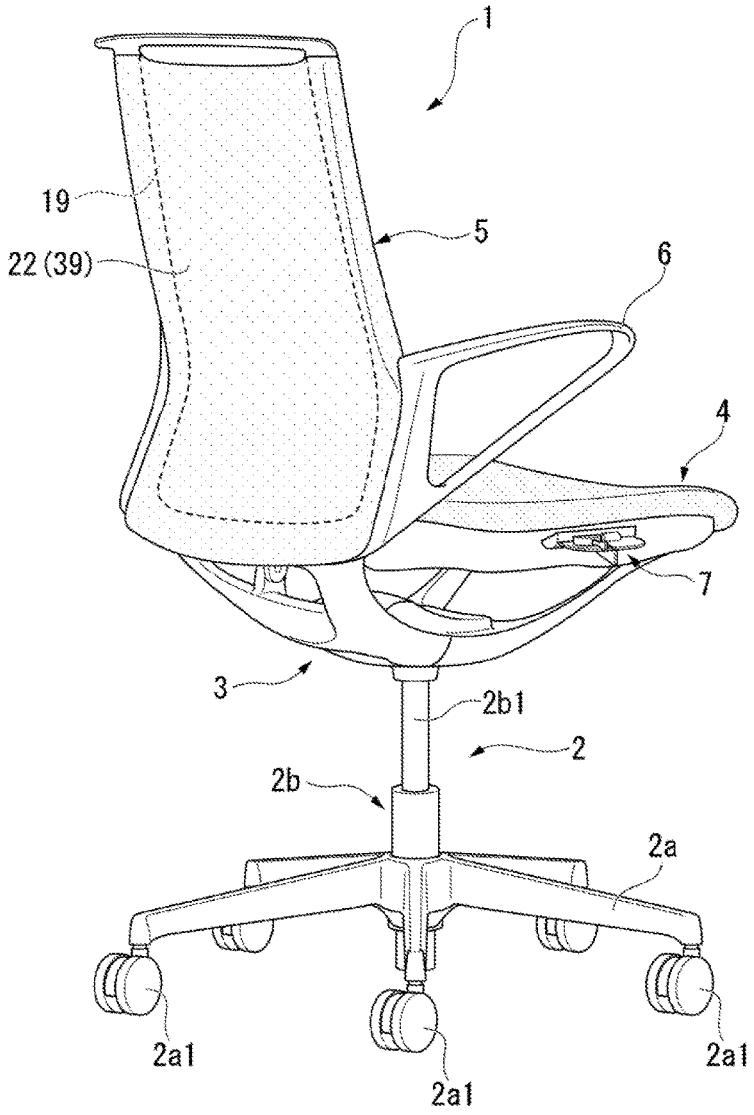
FIG. 2 is a perspective view when the chair according to the embodiment of the present invention is viewed from a rear surface side.

FIG. 1 is a perspective view when an embodiment of the chair of the present invention is viewed from the front surface side, FIG. 2 is a perspective view when the embodiment is viewed from the rear surface side, and a reference numeral 1 indicates the chair in the drawings. The chair 1 includes a leg portion 2 which is placed on a floor, a support base 3 which is installed on an upper end of the leg portion 2, a seat (seat body) 4 on which a person seats, a seat receiving member 15 which is attached to an upper surface of the support base 3 and supports the seat 4, and a backrest 5 which extends from the support base 3 to the rear upper side and support a back portion of a person who seats on the seat 4.

The leg portion 2 includes a multi-legged bar 2*a* with casters 2*a*1, and a leg pillar 2*b* which stands upright from a center portion of the multi-legged bar 2*a*, and the support base 3 is attached to an upper end portion of the leg pillar 2*b*. A gas spring is built in the leg pillar 2*b* and the leg pillar 2*b* can raise and lower a rod 2*b*1. In the leg portion 2, the casters 2*a*1 abut a floor and it is possible to move the chair 1 on a floor surface. A raising and lowering adjustment mechanism of the leg pillar 2*b* and an inclination adjustment mechanism of the backrest 5 are built in the support base 3.

The support base 3 is fixed to an upper end of the rod 2*b*1 of the leg pillar 2*b*, supports the seat 4 from below, and supports the backrest 5 in a lockable manner. The seat 4 is a portion which supports a seated person who is a user of the chair 1 from below and is supported from below by the support base 3. The backrest 5 is a portion which supports a seated person from behind and is tiltably supported to the support base 3. The armrest 6 is a portion which supports arms of a seated person from below and two armrests 6 are fixed to the backrest 5 such that the seat 4 is interposed therebetween in the right-left direction.

Figure 3:
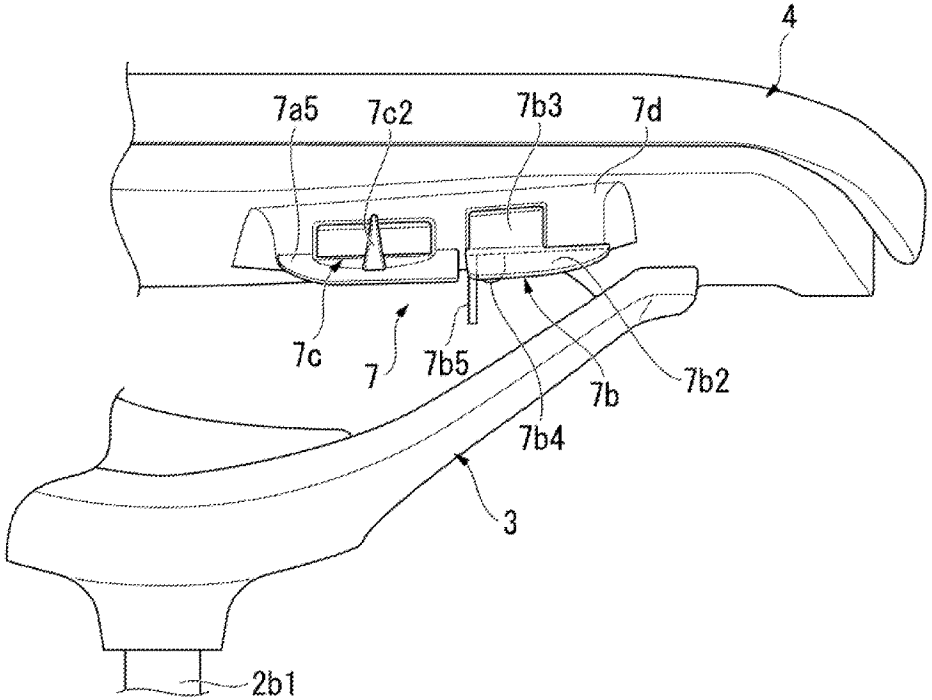
FIG. 3 is an enlarged side view having an operation unit included in the chair according to the embodiment of the present invention.
Figure 4:
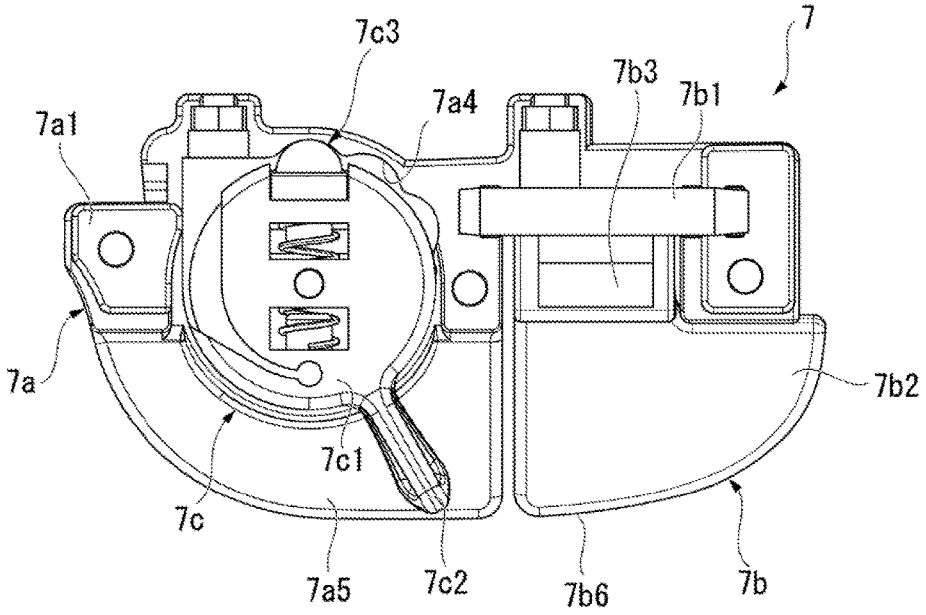
FIG. 4 is a plan view of the operation unit included in the chair according to the embodiment of the present invention.
Figure 5:
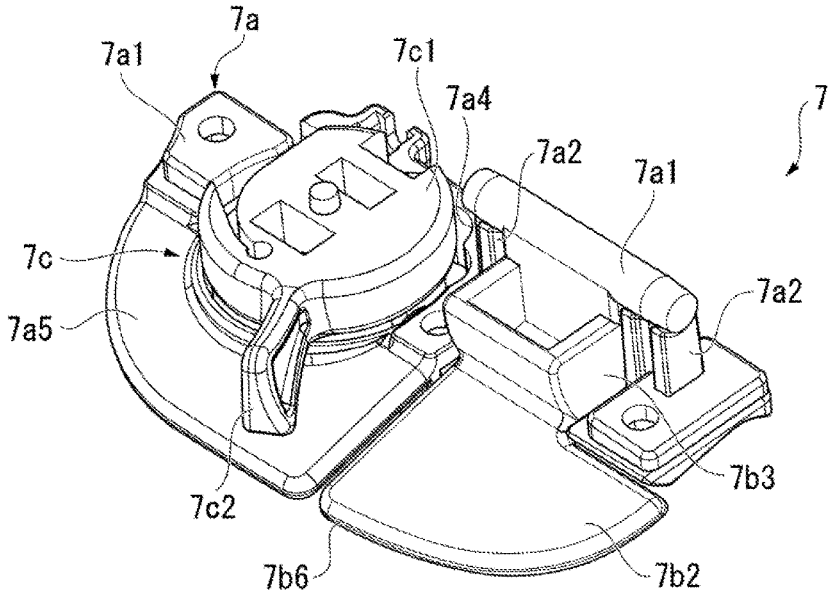
FIG. 5 is a perspective view when the operation unit included in the chair according to the embodiment of the present invention is viewed from a right side of the chair.
Figure 6:
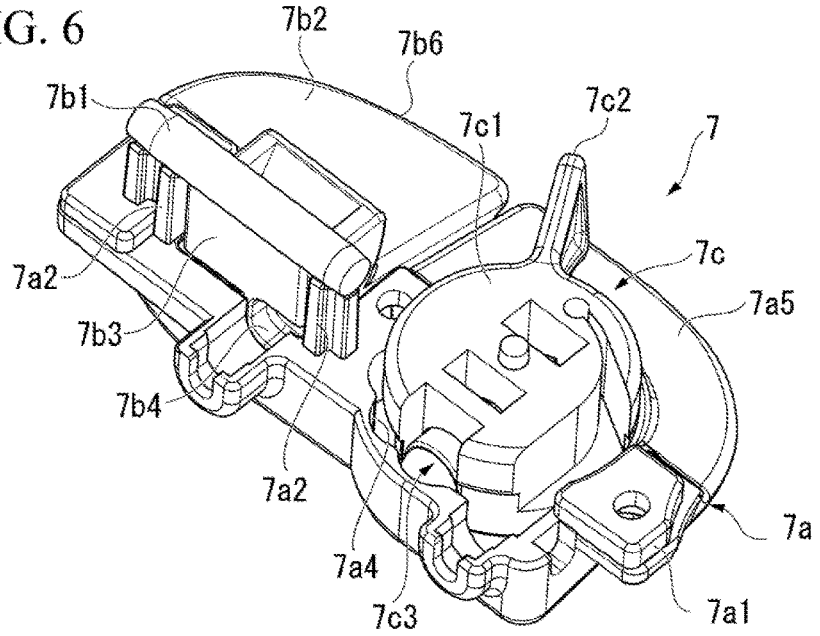
FIG. 6 is a perspective view when the operation unit included in the chair according to the embodiment of the present invention is viewed from a left side of the chair.
Figure 7:
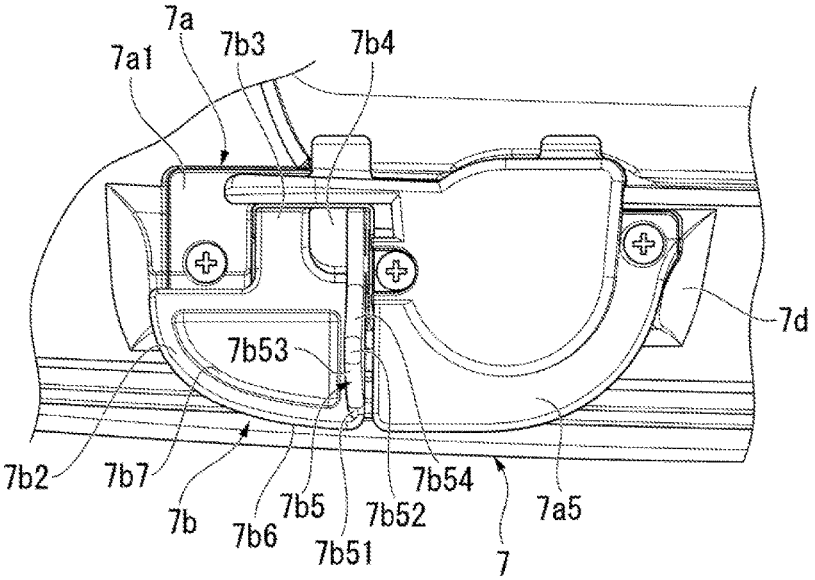
FIG. 7 is a bottom view having the operation unit included in the chair according to the embodiment of the present invention.

The chair 1 of the present embodiment further includes an operating unit 7 and as shown in FIG. 2, the operating unit 7 is provided on the right side portion of the seat 4. FIG. 3 is an enlarged side view including the operating unit 7. In addition, FIG. 4 is a plan view of the operating unit 7. FIG. 5 is a perspective view of the operating unit 7 when viewed from the right side of the chair 1. FIG. 6 is a perspective view of the operating unit 7 when viewed from the left side of the chair 1. FIG. 7 is a bottom view including the operating unit 7.

Figure 8:
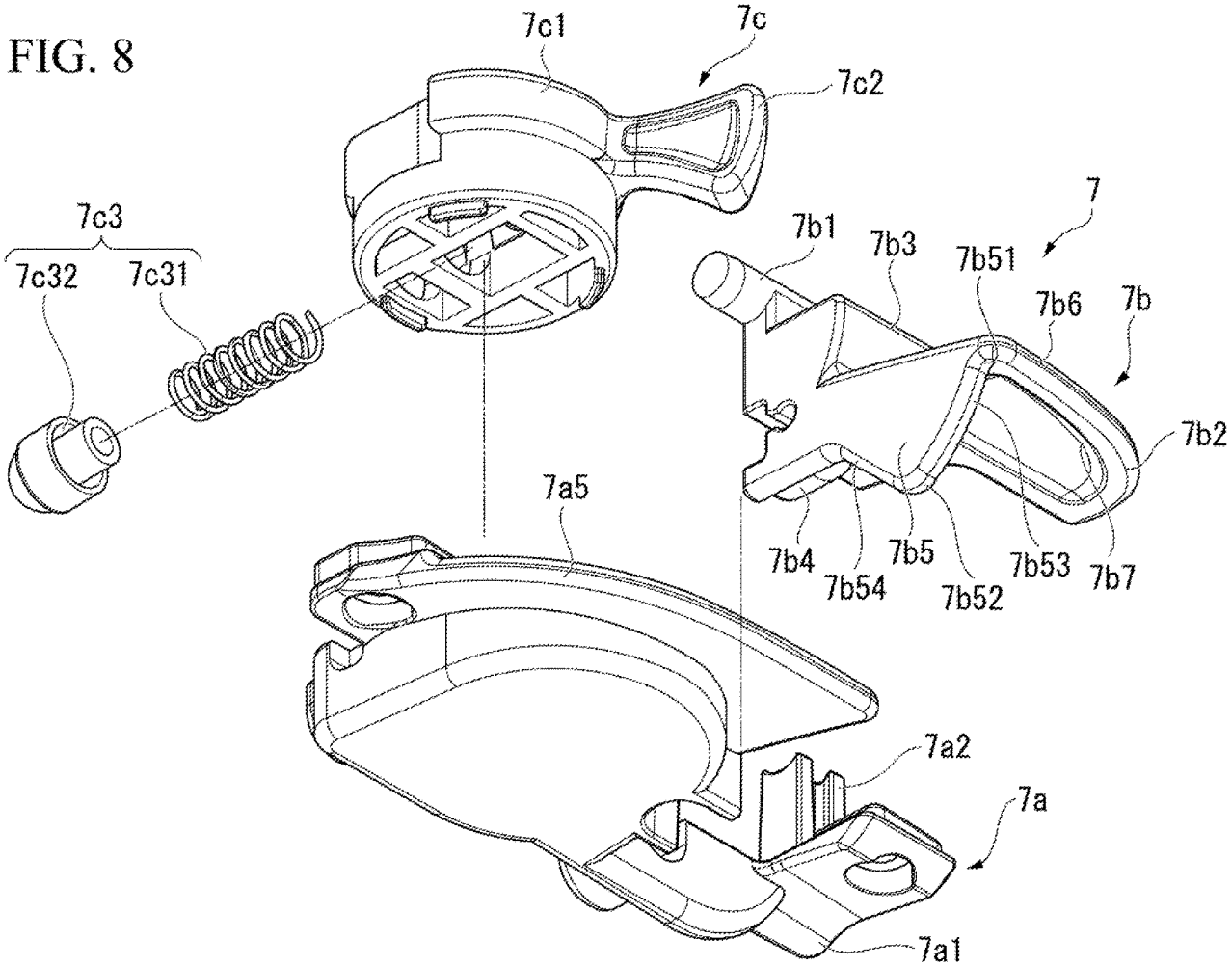
FIG. 8 is an exploded perspective view when the operation unit included in the chair according to the embodiment of the present invention is viewed from below.
Figure 9:
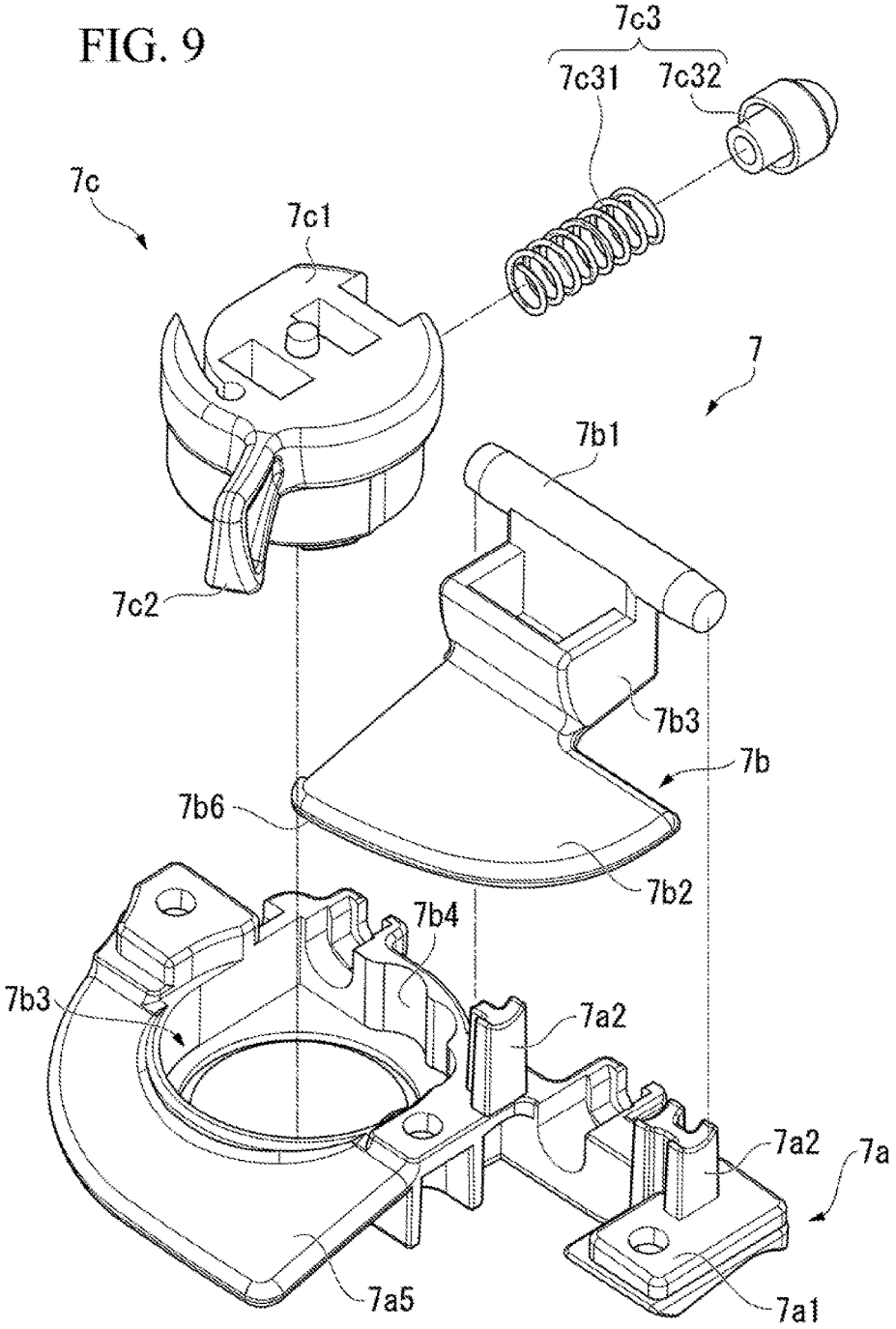
FIG. 9 is an exploded perspective view when the operation unit included in the chair according to the embodiment of the present invention is viewed from above.

FIG. 8 is an exploded perspective view of the operating unit 7 when viewed from below. FIG. 9 is an exploded perspective view of the operating unit 7 when viewed from above. In addition, a cover 7*d* described later is not shown in FIGS. 4 to 6, 8, and 9.

As shown in the drawings, the operating unit 7 includes a holder 7*a*, a raising/lowering operation member 7*b* (operation member), a locking adjustment operation member 7*c* (second operation member), and a cover 7*d* (refer to FIG. 7).

The holder 7*a* is fixed to the side portion of the seat 4 by a bolt (not shown) or the like, and movably supports the raising/lowering operation member 7*b* and the locking adjustment operation member 7*c* from below. The holder 7*a* includes a base portion 7*a*1 and bearing portions 7*a*2 which protrude upward from the base portion 7*a*1 and rotatably support a pivot 7*b*1 (will be described later) of the raising/lowering operation member 7*b*.

An accommodation groove 7*a*3 which rotatably supports a body 7*c*1 (will be described later) of the locking adjustment operation member 7*c* around a vertical axis is provided in the base portion 7*a*1. In addition, a wave-shaped portion 7*a*4 for guiding a tip portion 7*c*32 of a knock mechanism 7*c*3 (will be described later) of the locking adjustment operation member 7*c* is formed on an inner wall surface of the accommodation groove 7*a*3.

In addition, a flange 7*a*5 (adjacent member) which extends from the formation location of the accommodation groove 7*a*3 toward the right side of the chair 1 is provided in the base portion 7*a*1. The flange 7*a*5 is provided below a lever 7*c*2 (will be described later) of the locking adjustment operation member 7*c* and is a plate-shaped portion in which the front and rear surfaces face upward and downward. For example, a display indicating the strength of locking is drawn on the upper surface of the flange 7*a*5. The flange 7*a*5 is provided to be adjacent to an operation plate 7*b*2 (will be described later) of the raising/lowering operation member 7*b*, corresponds to the adjacent member of the present invention, and is disposed so as to be the same height as that of the operation plate 7*b*2 in a normal posture.

The raising/lowering operation member 7*b* is connected to the leg pillar 2*b* by a drive wire (not shown) or the like and is an operation member for adjusting the amount (the height of the seat 4) of expansion/contraction of the rod 2*b*1. The raising/lowering operation member 7*b* is positioned by being supported by the holder 7*a* from below and pressed by the cover 7*d* provided above.

Figure 10:
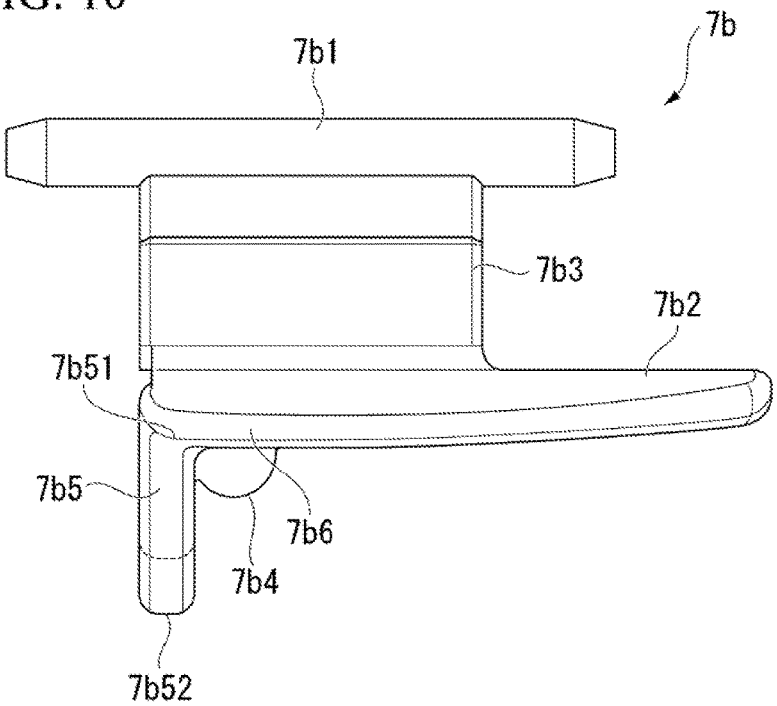
FIG. 10 is a side view when a raising/lowering operation member included in the chair according to the embodiment of the present invention is viewed from the right side of the chair.

FIG. 10 is a side view of the raising/lowering operation member 7*b* when viewed from the right side of the chair 1. As shown in FIG. 10 or FIGS. 8 and 9, the raising/lowering operation member 7*b* include the pivot 7*b*1, the operation plate 7*b*2, a connection portion 7*b*3, a protrusion portion 7*b*4, and a shielding piece 7*b*5 (shielding portion).

The pivot 7*b*1 is a shaft portion which horizontally extends in a forward-rearward direction of the chair 1 and is rotatably supported by the bearing portions 7*a*2 of the holder 7*a* from below (for example, refer to FIGS. 4 to 6). The operation plate 7*b*2 is connected to the pivot 7*b*1 via the connection portion 7*b*3 and has a plate shape in which a tip 7*b*6 protrudes toward the right side of the chair 1. The operation plate 7*b*2 is disposed such that the front and rear surfaces face upward and downward and is rotatable about the pivot 7*b*1 such that the tip 7*b*6 side moves upward and downward. The operation plate 7*b*2 is a portion which is operated when a seated person raises and lowers the seat 4, and a recess 7*b*7 is provided on the lower surface side of the operation plate 7*b*2 such that a fingertip of a seated person is easily hooked.

As described above, the connection portion 7*b*3 is a portion which connects the pivot 7*b*1 and the operation plate 7*b*2 to each other and is provided such that the lower surface is continuous with the lower surface of the operation plate 7*b*2. The protrusion portion 7*b*4 is provided on the lower surface of the connection portion 7*b*3 and protrudes downward from the lower surface of the connection portion 7*b*3. The protrusion portion 7*b*4 is configured to discomfort to a seated person in a case where the fingertip of the seated person is hooked to the lower surface of the connection portion 7*b*3 when the seated person operates the raising/lowering operation member 7*b*, and the fingertip of the seated person is guided to the operation plate 7*b*2 using the feeling of the seated person's discomfort.

Figure 11:
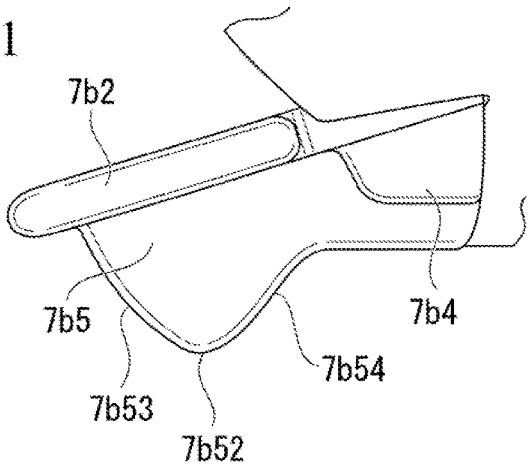
FIG. 11 is a front view when a shielding piece included in the chair according to the embodiment of the present invention is viewed from the front side of the chair.

FIG. 11 is a front view when the shielding piece 7*b*5 is viewed from the front side of the chair 1. The shielding piece 7*b*5 protrudes downward from the edge portion of the operation plate 7*b*2 on the flange 7*a*5 side and is a plate-shaped portion in which the front and rear surfaces face in the forward-rearward direction (an arrangement direction of the raising/lowering operation member 7*b* and the flange 7*a*5) of the chair 1.

As shown in FIG. 11, when viewed from the front surface side of the chair 1, a protrusion amount of the shielding piece 7*b*5 from the lower surface of the operation plate 7*b*2 increases inward from an end portion (front end 7*b*51) on the tip 7*b*6 side of the operation plate 7*b*2, the protrusion amount decreases inward from a maximum protrusion portion 7*b*52, and the protrusion amount in the intermediate portion is approximately constant. As shown in FIG. 11, the shielding piece 7*b*5 includes a curved side 7*b*53 which is closer to the front end 7*b*51 side than the maximum protrusion portion 7*b*52 and an inclined side 7*b*54 which is positioned further inward in the operation plate 7*b*2 than the maximum protrusion portion 7*b*52.

When the tip 7*b*6 of the operation plate 7*b*2 rotates about the pivot 7*b*1, an arc length of a curvature of the curved side 7*b*53 is set such that a portion of the curved side 7*b*53 when viewed from the front side of the chair 1 always overlaps the tip of the flange 7*a*5. Accordingly, it is possible to always prevent the tip of the flange 7*a*5 from protruding from the shielding piece 7*b*5 when viewed from the front side of the chair 1 even in a case where the operation plate 7*b*2 is rotated.

The inclined side 7*b*54 is inclined downward from the inner side of the operation plate 7*b*2 toward the tip 7*b*6 side. The inclined side 7*b*54 guides a fingertip of a seated person to the tip side of the operation plate 7*b*2 in a case where the fingertip of the seated person is hooked to the shielding piece 7b5 when the seated person operates the operation plate 7b2.

In the raising/lowering operation member 7b having the shielding piece 7b5, a state (refer to FIG. 5) where the operation plate 7b2 is positioned at the same height as that of the flange 7a5 is a normal posture in which raising and lowering of the seat 4 are not performed, and a state where the tip 7b6 side of the operation plate 7b2 is raised is an operation posture in which the raising and lowering of the seat 4 are performed. A seated person changes the raising/lowering operation member 7b from the normal posture to the operation posture, and the raising and lowering of the seat 4 can be performed.

Figure 12A:
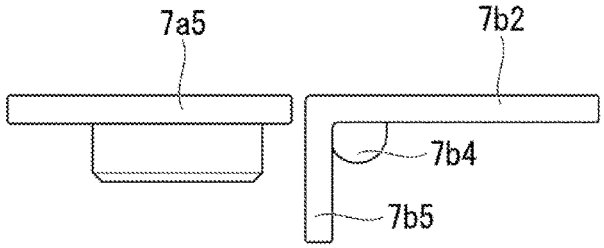
FIG. 12A is a schematic view in a state where an operation plate has a normal posture to explain an operation of the raising/lowering operation member included in the chair according to the embodiment of the present invention.
Figure 12B:
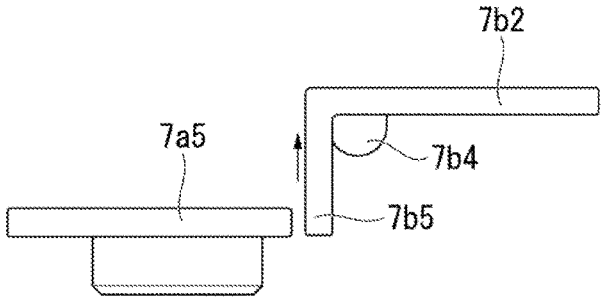
FIG. 12B is a schematic view in a state where the operation plate has an operation posture to explain the operation of the raising/lowering operation member included in the chair according to the embodiment of the present invention.

In addition, it is possible to prevent a fingertip of a seated person from entering from the operation plate 7b2 side to the gap between the operation plate 7b2 and the flange 7a5 in the operation posture by the shielding piece 7b5 provided in the raising/lowering operation member 7b. FIGS. 12A and 12B are schematic views showing the operation of the raising/lowering operation member 7b. FIG. 12A shows a state where the operation plate 7b2 has the normal posture, and FIG. 12B shows a state where the operation plate 7b2 has the operation posture. As shown in the drawings, the shielding piece 7b5 closes the gap which is generated by the operation plate 7b2 and the flange 7a5 when the raising/lowering operation member 7b has the operation posture. Accordingly, it is possible to prevent the gap formed between the operation plate 7b2 and the flange 7a5 from being exposed to a seated person side, and it is possible to prevent the fingertip of the seated person from entering from the operation plate 7b2 side into the gap.

As shown in FIGS. 8 and 9, the locking adjustment operation member 7c includes the column-shaped body 7c1, the lever 7c2 which protrudes from the circumferential surface of the body 7c1, and a knock mechanism 7c3 which is provided in the body 7c1. The body 7c1 is rotatably accommodated in the accommodation groove 7a3 provided in the base portion 7a1 of the holder 7a around the vertical axis. The body 7c1 is positioned by being supported by the holder 7a from below and pressing by the cover 7d positioned above.

The lever 7c2 protrudes toward the flange 7a5 side. A seated person holds and turns the lever 7c2 and the body 7c1 is rotated. The body 7c1 is connected to the support base 3 by a drive wire (not shown) or the like and adjusts strength of locking by the rotation position of the body 7c1. The knock mechanism 7c3 includes a spring 7c31 which is embedded in the body 7c1 such that the tip protrudes toward the side and a tip portion 7c32 which is provided in the tip of the spring 7c31. The knock mechanism 7c3 presses the tip portion 7c32 to the wave-shaped portion 7a4 of the holder 7a by a biasing force of the spring 7c31, and a striking sound generated when the tip portion 7c32 rides over a wave-shaped tip of the wave-shaped portion 7a4 informs a seated person of the rotation position of the locking adjustment operation member 7c.

In the chair 1 of the present embodiment configured as described above, the seat 4 can be raised and lowered by rotating the operation plate 7b2 of the raising/lowering operation member 7b to be lifted. In addition, the strength of the locking is adjusted by rotating the body 7c1 of the locking adjustment operation member 7c using the lever 7c2.

The above-described chair 1 of the present embodiment includes the raising/lowering operation member 7b which is changed from the normal posture to the operation posture by the operation of a seated person and the flange 7a5 which is disposed to be adjacent to the raising/lowering operation member 7b. In addition, the raising/lowering operation member 7b includes the shielding piece 7b5 which closes the gap generated by the operation plate 7b2 of the raising/lowering operation member 7b and the flange 7a5 when the raising/lowering operation member 7b has the operation posture. Accordingly, even in a case where the raising/lowering operation member 7b is provided at a position which is not easily viewed from a seated person and the raising/lowering operation member 7b is operated without being viewed, it is possible to prevent the finger of the seated person from being interposed between the raising/lowering operation member 7b and the flange 7a5, and it is possible to prevent discomforting the seated person.

In addition, in the chair 1 of the present embodiment, the raising/lowering operation member 7b includes the pivot 7b1 which extends in the horizontal direction, and the operation plate 7b2 which has a plate shape in which the front and rear surfaces face upward and downward and has the operation posture by raising the tip 7b6 side about the pivot 7b1. Moreover, in the chair 1 of the present embodiment, the flange 7a5 is provided, which is positioned adjacent to the operation plate 7b2 and is disposed so as to be the same height as that of the operation plate 7b2 in the raising/lowering operation member 7b having the normal posture and in which the front and rear surfaces face upward and downward. In the chair 1 of the present embodiment, since the operation plate 7b2 included in the raising/lowering operation member 7b and the flange 7a5 are arranged to be the same height as each other in the case where the raising/lowering operation member 7b is in the normal posture, the sense of unity of the raising/lowering operation member 7b and the flange 7a5 increases, and an aesthetic appearance is obtained.

Meanwhile, since the tip 7b6 of the operation plate 7b2 moves upward and downward and the posture of the raising/lowering operation member 7b is changed, a gap is easily generated between the operation plate 7b2 and the flange 7a5. With respect to this, since the chair 1 of the present embodiment includes the shielding piece 7b5, even in the structure having the sense of unity, it is possible to prevent a finger of a seated person from being interposed between the raising/lowering operation member 7b and the flange 7a5, and it is possible to prevent discomforting the seated person.

Moreover, in the chair 1 of the present embodiment, the shielding piece 7b5 protrudes downward from the edge portion on the flange 7a5 side of the operation plate 7b2 and is provided such that the front and rear surfaces face in the arrangement direction between the raising/lowering operation member 7b and the flange 7a5. Accordingly, the operation plate 7b2 and the shielding piece 7b5 are integrated, and it is possible to provide the shielding piece 7b5 without increasing the number of parts. In addition, in a case where the operation plate 7b2 is viewed from above, the shielding piece 7b5 is not easily viewed in appearance, and the aesthetic appearance is not damaged by the shielding piece 7b5.

In addition, in the chair 1 of the present embodiment, the shielding piece 7b5 includes the inclined side 7b54 which faces downward from the inner side of the operation plate 7b2 toward the tip 7b6 side. For example, in a case where the operation plate 7b2 is disposed at the position which is not easily viewed from a seated person as the chair 1 of the present embodiment, the fingertip of the seated person is likely to be hooked to the root of the operation plate 7b2. Since the root of the operation plate 7b2 is close to the pivot 7*b*1, it is necessary to operate the operation plate 7*b*2 by a very strong force in a case where the posture of the operation plate 7*b*2 is changed in a state where the fingertip is hooked to the root of the operation plate 7*b*2, and the seated person is likely to feel deterioration of operability. Meanwhile, according to the chair 1 of the present embodiment, if a great force is applied to the inner side (that is, the root side) of the operation plate 7*b*2, a fingertip of a seated person easily moves toward the tip 7*b*6 side of the operation plate 7*b*2 along the inclined side 7*b*54, and it is possible to guide the fingertip of the seated person to the tip 7*b*6 side of the operation plate 7*b*2 at which the operation is easily performed by the fingertip of the seated person without awareness of the seated person. Therefore, according to the chair 1 of the present embodiment, it is possible to operate the raising/lowering operation member 7*b* with a weak force, and excellent operability is obtained.

In addition, in the chair 1 of the present embodiment, the raising/lowering operation member 7*b* includes the connection portion 7*b*3 which connects the operation plate 7*b*2 and the pivot 7*b*1 to each other and the protrusion portion 7*b*4 which is provided on the lower surface of the connection portion 7*b*3. According to the chair 1 of the present embodiment, since the connection portion 7*b*3 is provided, it is possible to provide the operation plate 7*b*2 so as to be further separated from the pivot 7*b*1, and it is possible to operate the operation plate 7*b*2 with a weaker force. In addition, since the protrusion portion 7*b*4 is provided on the lower surface of the connection portion 7*b*3, even in a case where the operation plate 7*b*2 is disposed at the position at which it is not easily viewed from the seated person, it is possible to prevent a fingertip of a seated person from being hooked to the lower surface of the connection portion 7*b*3 close to the pivot 7*b*1 due to interference of the protrusion portion 7*b*4. Accordingly, it is possible to guide the fingertip of the seated person to the tip 7*b*6 side of the operation plate 7*b*2 which is more easily operated by the fingertip of the seated person.

In addition, the chair 1 of the present embodiment includes the locking adjustment operation member 7*c* which has the lever 7*c*2 moving along the upper surface of the flange 7*a*5 and is rotatable by the lever 7*c*2 which is moved by a user. Accordingly, since the raising/lowering operation member 7*b* and the locking adjustment operation member 7*c* can be provided so as to be close to each other, it is possible to obtain excellent operability in the chair 1 of the present embodiment.

In addition, according to the chair 1 of the present embodiment, in the chair 1 in which excellent operability is obtained, it is possible to prevent a finger of a seated person from being interposed between the raising/lowering operation member 7*b* and the flange 7*a*5.

Hereinbefore, the preferred embodiment of the present invention is described with reference to the accompanying drawings. However, the present invention is not limited to the embodiment. The shape, the combination, or the like of each component described in the above-described embodiment is only an example, and various modifications can be applied to the present invention based on design requirements or the like within a scope which does not depart from the gist of the present invention.

For example, in the above-described embodiment, the configuration is described in which the operation member of the present invention is the raising/lowering operation member 7*b* and the adjustment member of the present invention is the flange 7*a*5. However, the present invention is not limited to this. For example, when a depth adjustment operation member for adjusting a depth position of the seat is provided, the depth adjustment operation member may be set to the adjacent member with respect to the raising/lowering operation member 7*b*, and a shielding piece for closing a gap between the raising/lowering operation member 7*b* and the depth adjustment operation member may be provided.

Moreover, in the above-described embodiment, the configuration in which the shielding piece 7*b*5 is provided in the operation plate 7*b*2 is described. However, the present invention is not limited to this, and an upward shielding piece may be provided in the flange 7*a*5.

Moreover, in the above-described embodiment, the configuration in which the plate-shaped shielding piece 7*b*5 functions as the shielding portion of the present invention is described. However, the present invention is not limited to this.

In addition, in the above-described embodiment, the example in which the present invention is applied to a chair is described. However, the present invention is not limited to this and can be applied to furniture other than the chair.

Figure 13:
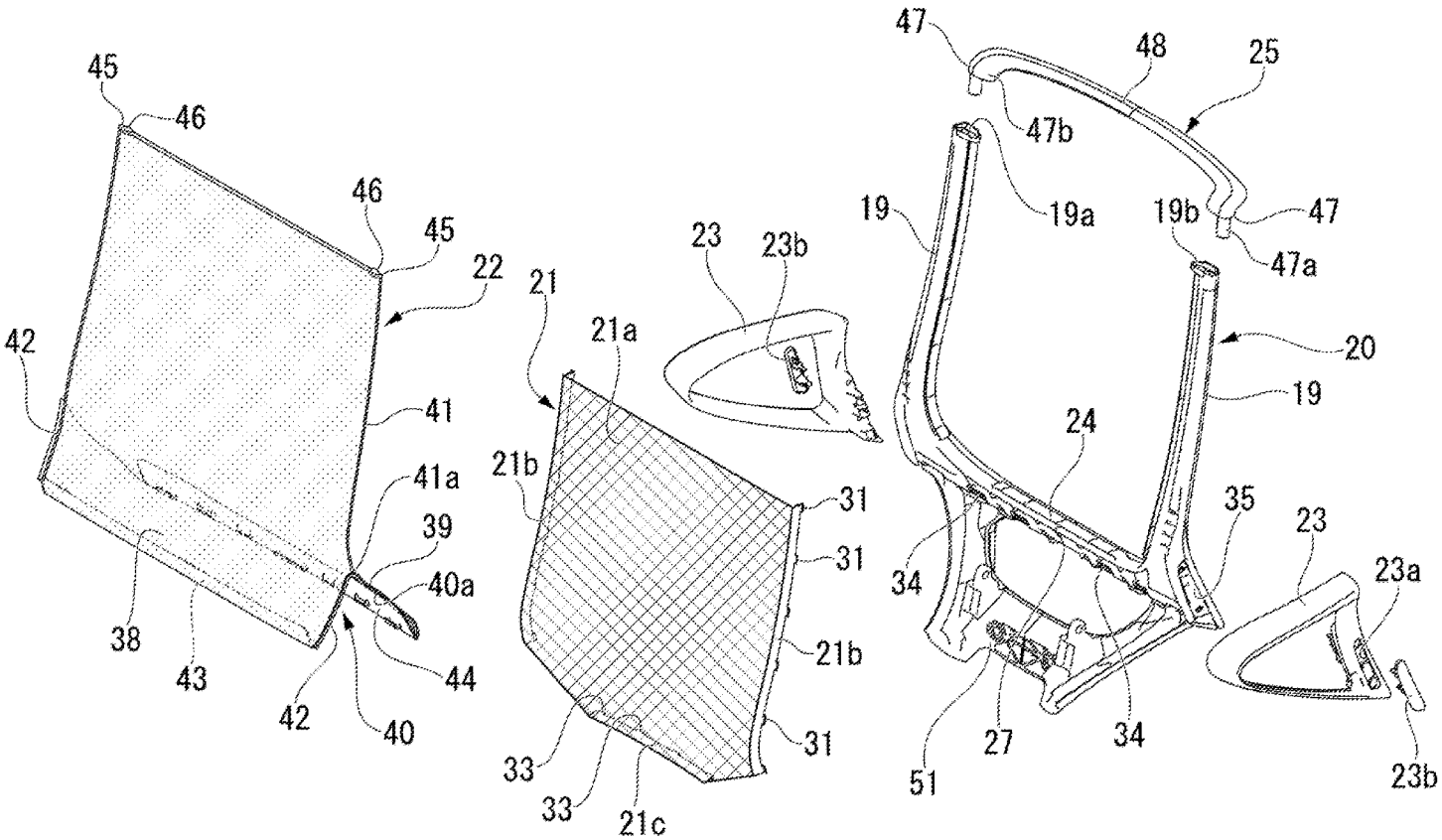
FIG. 13 is an exploded perspective view of a backrest according to an embodiment of a load support member for a chair according to the present invention.

The backrest 5 is an embodiment of the load support member for a chair according to the present invention, and as shown in FIG. 13 which is an exploded perspective view of the backrest 5, the backrest 5 includes a frame member 20 having a pair of rod members 19 and 19 which are separated from each other in a width direction (right-left direction) of the chair 1 and is disposed to be approximately parallel to each other, a surface material 21 (interior material) which is bridged between the pair of rod members 19 and 19, and a bag-shaped extension material 22 (exterior material) which covers the pair of rod members 19 and 19, and armrests 6 which are attached to both sides of the frame member 20 in the width direction.

Figure 14A:
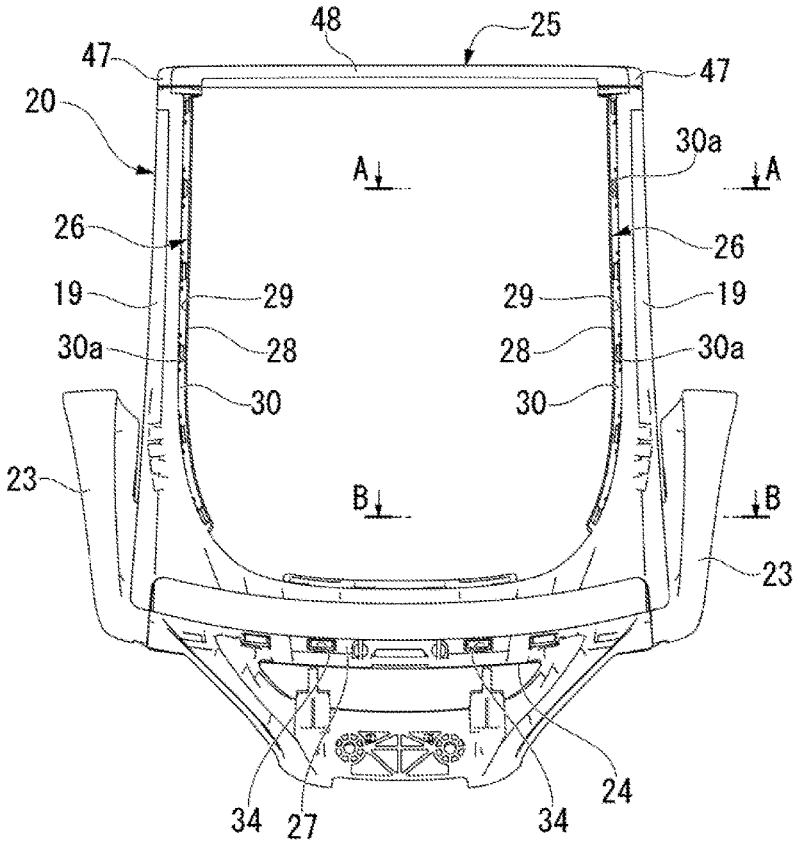
FIG. 14A is a front view showing a schematic configuration of a frame member.
Figure 14B:
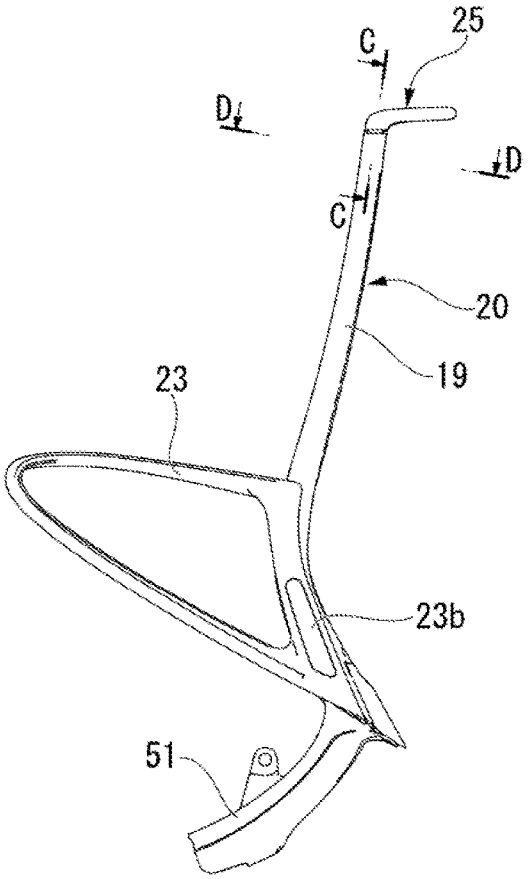
FIG. 14B is a side view showing the schematic configuration of the frame member.

As shown in FIGS. 14A and 14B which are schematic configuration views of the frame member 20, the frame member 20 includes the pair of rod members 19 and 19 and a lower frame portion 24 which is integrally provided on the lower end portions (the other end portions) of the rod members 19 and 19, and a connection frame 25 is attached to the upper end portions (one end portion) of the pair of rod members 19 and 19.

In addition, in the present embodiment, as described above, the armrests 6 are respectively attached to both sides of the frame member 20 in the width direction, that is, connection portions between the pair of rod members 19 and 19 and the lower frame portion 24. However, in the load support member (backrest 5) for a chair according to the present invention, the armrests 6 may not be attached to the frame member 20.

As shown in FIG. 13, the surface material 21 is formed in an approximately rectangular shape and is configured of a surface material main body 21*a* which is formed of a mesh material, elastomer, or the like, side portion support frames 21*b* and 21*b* (fitting protrusion portion) which are provided on both sides of the surface material main body 21*a* in the width direction, and a lower portion support frame 21*c* which is provided on the lower end of the surface material main body 21*a*. The side portion support frame 21*b* or the lower portion support frame 21*c* is attached toward the rear side (rear surface direction) of the surface material 21 by stitching or the like. The side portion support frames 21*b* and 21*b* are supported so as to be attached to side support portions 26 (support portions) of the rod member 19 shown in FIG. 14A, the lower portion support frame 21*c* is supported so as to be attached to a lower support portion 27 of the lower frame portion 24, and the surface material 21 is fixed to the frame member 20.

Figure 15:
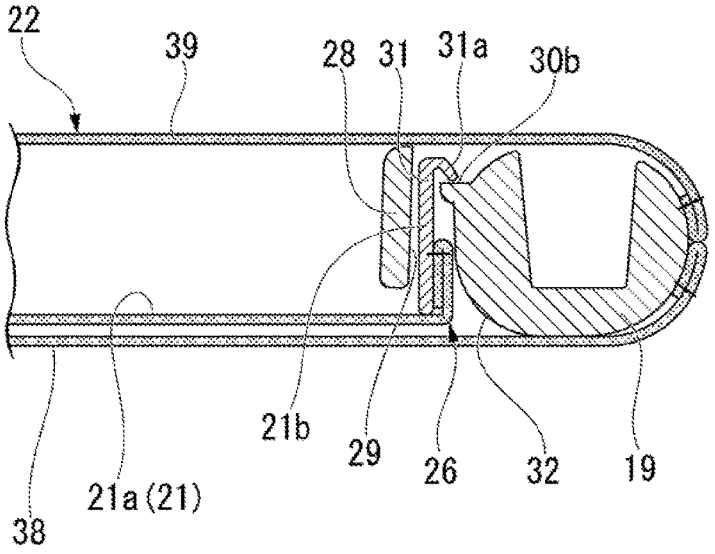
FIG. 15 is a sectional view taken along line A-A of FIG. 14A.

The side support portions 26 are respectively provided on the inner surfaces facing each other of the pair of rod members 19 and 19, and as shown in FIG. 15 which is a sectional view taken along line A-A of FIG. 14A, and the side support portion 26 is formed by the rod member 19 and a thin plate-shaped support material 28 which is disposed on the inner surface side of the rod member 19 along the rod member 19 with a gap. That is, the gap formed between the rod member 19 and the support material 28 becomes a fitting recessed portion 29 for attaching the side portion support frame 21*b* of the surface material 21. In addition, as shown in FIG. 14A, an attachment plate 30 for the support materials 28 to the rod members 19 are provided on the rear sides (rear surface sides) of the rod members 19 and the support materials 28 between the rod members 19 and the support materials 28. A plurality of attachment openings 30*a* (six in FIG. 14A) are provided on each attachment plate 30 at approximately equal intervals in the up-down direction.

The fitting recessed portion 29 is opened to the front side (front surface side) of the chair 1, that is, a side (a load receiving surface side) which receives a load of a seated person, and as shown in FIG. 15, the side portion support frame 21*b* of the surface material 21 is fitted into the fitting recessed portion 29. As shown in FIG. 13, a plurality (six in FIG. 13) of pawl portions 31 are formed on the rear end portions of the side portion support frames 21*b*. Each of the pawl portions 31 is inserted into the attachment opening 30*a* of the attachment plate 30, and is locked to a retaining protrusion portion 30*b* of the rod member 19 shown in FIG. 15.

That is, the pawl portion 31 protrudes rearward from the rear end of the side portion support frame 21*b*, is bent toward the outside of the chair 1 in the width direction, and thereafter, is formed to be folded to the front side. In addition, the folded portion 31*a* is locked to the retaining protrusion portion 30*b* formed at the innermost portion on the rear surface side of the rod member 19, and the side portion support frame 21*b* is restrained from coming out from the inside of the fitting recessed portion 29. That is, if the folded portion 31*a* enters the fitting recessed portion 29, the folded portion 31*a* is elastically deformed in a direction orthogonal to the depth direction when the folded portion 31*a* rides over the retaining protrusion portion 30*b*. In addition, after the folded portion 31*a* rides over the retaining protrusion portion 30*b*, the folded portion 31*a* is elastically returned and is locked to the retaining protrusion portion 30*b*. Accordingly, it is possible to complete fitting of the folded portion 31*a* with respect to the fitting recessed portion 29 by only pushing the folded portion 31*a* into the fitting recessed portion 29. A retaining portion according to the present invention, that is, a retaining portion by which the side portion support frame 21*b* and the fitting recessed portion 29 are locked to each other and the side portion support frame 21*b* is restrained from coming out from the inside of the fitting recessed portion 29 is formed by the folded portion 31*a* of the pawl portion 31 formed on the rear end portion of the side portion support frame 21*b* and the retaining protrusion portion 30*b* formed at the innermost portion of the fitting recessed portion 29.

In addition, when the side portion support frames 21*b* are fitted into the fitting recessed portions 29, the plurality of pawl portions 31 are fitted into the corresponding attachment openings 30*a* and the folded portions 31*a* are locked to the retaining protrusion portions 30*b*.

Here, in the side support portion 26 (support portion) of the rod member 19, a transition surface 32 for guiding the side portion support frame 21*b* to the fitting recessed portion 29 is formed on the outside of the chair 1 in the width direction on the outer circumferential portion of the opening of the fitting recessed portion 29. In the present embodiment, the transition surface 32 is formed in a portion from the end portion of the front surface side (front surface side of the chair 1) of the rod member 19 to the opening end of the fitting recessed portion 29. The transition surface 32 is formed to be inclined to be close to the opening portion of the fitting recessed portion 29 such that the opening of the fitting recessed portion 29 is narrowed toward the rear side (rear surface side of the chair 1) of the rod member 19. In the present embodiment, the transition surface 32 is provided on the inner surface side of the rod member 19 which forms the fitting recessed portion 29, and is formed in an arc shape, which is expanded toward the inner surface side of the rod member 19, in a cross-sectional view on the front surface side (the front surface side of the chair 1) of the rod member 19.

According to this configuration, when the side portion support frame 21*b* of the surface material 21 is fitted in to the fitting recessed portion 29, for example, the pawl portion 31 side of the side portion support frame 21*b* abuts the transition surface 32 outside the fitting recessed portion 29. Thereafter, by sliding the pawl portion 31 side of the side portion support frame 21*b* along the inclination of the transition surface 32, it is possible to easily fit the side portion support frame 21*b* into the fitting recessed portion 29 due to the guiding of the inclination (transition surface 32). Accordingly, after the side portion support frame 21*b* is fitted into the fitting recessed portion 29, the pawl portion 31 enters the attachment opening 30*a*, the folded portion 31*a* is locked to the retaining protrusion portion 30*b*, and it is possible to fix the side portion support frame 21*b* to the side support portion 26.

Moreover, the support material 28 becomes a free end on which the opening side (the front surface side of the chair 1) of the fitting recessed portion 29 is swingably formed. Accordingly, it is possible to easily fit the side portion support frame 21*b* into the fitting recessed portion 29. That is, the free end (support material 28) is expanded using one hand holding the surface material 21 and the other hand, and in this state, it is possible to fit the side portion support frame 21*b* into the fitting recessed portion 29.

In addition, the tip portion (the end portion on the front surface side of the chair 1) on the free end of the support material 28 is positioned to be closer to the rear surface side of the chair 1 than the end surface (end portion) on the front surface side (the front surface side of the chair 1) of the portion of the rod member 19 in which the fitting recessed portion 29 is formed. Accordingly, the position of the surface material 21 is further retreated (off-set) to the rear surface side of the chair 1 than the end portion of the front surface side (load receiving surface side) of the rod member 19. Accordingly, since the surface material 21 abut the front surface side of the extension material 22 described later from the rear side, deformation of the extension material 22 is prevented. Moreover, the surface material 21 is attached so as to fill a bump between the tip portion of the free end and the end portion on the front surface side of the rod member 19, and the surface material 21 and the rod member 19 can be continued to each other without a bump in a state of being supported to each other.

In addition, as shown in FIG. 13, the pawl portions 33 are also formed on the lower portion support frame 21*c*, the pawl portions 33 are fitted into the attachment opening 34 in the lower support portion 27 of the lower frame portion 24, and the lower portion support frame 21*c* is fixed to the lower frame portion 24. That is, a retaining portion having configurations similar to the folded portion 31*a* of the pawl portion 31 and the retaining protrusion portion 30*b* is formed between the pawl portion 33 of the lower portion support frame 21*c* and the attachment opening 34 of the lower support portion 27 if necessary, and the lower portion support frame 21*c* is fixed to the lower frame portion 24 by the retaining portion. In this way, the side portion support frames 21*b* and 21*b* and the lower portion support frame 21*c* are fixed to the frame member 20, and the surface material 21 is also fixed to the frame member 20.

In the present embodiment, the surface material 21 fixed to the frame member 20 is an elastic body (elastic resistance body) which receives and repels load (body weight) which is applied to the surface material main body 21*a* by a back portion of a seated person, that is, a load in a surface perpendicular direction (a direction orthogonal to the surface). The surface material main body 21*a* is formed of a mesh material or elastomer, is formed to be elastically deformed, and is configured to exert a repulsive force when receiving the load in the surface perpendicular direction. Moreover, the side portion support frame 21*b* or the lower portion support frame 21*c* is formed of a resin which can be elastically deformed.

Figure 16:
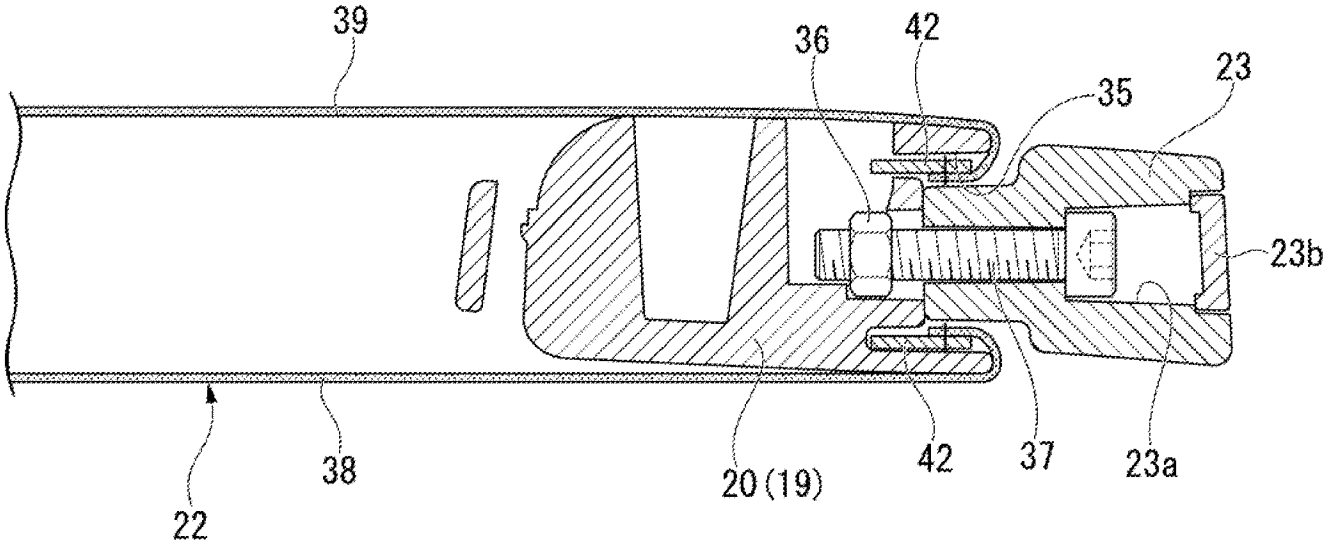
FIG. 16 is a sectional view of a main portion taken along line B-B of FIG. 14A.

Moreover, recessed portions 35 are formed in the frame member 20, and the recessed portions 35 are opened to the outside in the width direction on lower end edge sides (the other end edge sides) of both sides in the width direction, that is, portions intersecting the lower frame portion 24. As shown in FIG. 16 which is a sectional view of a main portion taken along line B-B of FIG. 14A, the recessed portion 35 is formed to the inner portion of the rod member 19, and in the present embodiment, the armrest 6 (closing member) is attached so as to close the opening of the recessed portion 35. That is, the armrest 6 is detachably fixed to a nut 36, which is embedded in the recessed portion 35, by a bolt 37.

In addition, a connection plate 42 which connects the side opening of the extension material 22 described later is provided in the recessed portion 35. Moreover, a through hole 23*a* for attaching the bolt 37 to the inside of the armrest 6 is formed in the armrest 6, and a cover plate 23*b* which closes the through hole 23*a* is attached to the opening portion outside the through hole 23*a*. The opening portion outside the through hole 23*a* is formed to be the same opening shape as that of the recessed portion 35 to which the armrest 6 is attached. According to this configuration, when the armrest 6 is not attached to the recessed portion 35, it is possible to close the opening by attaching the cover plate 23*b* to the recessed portion 35.

Figure 17:
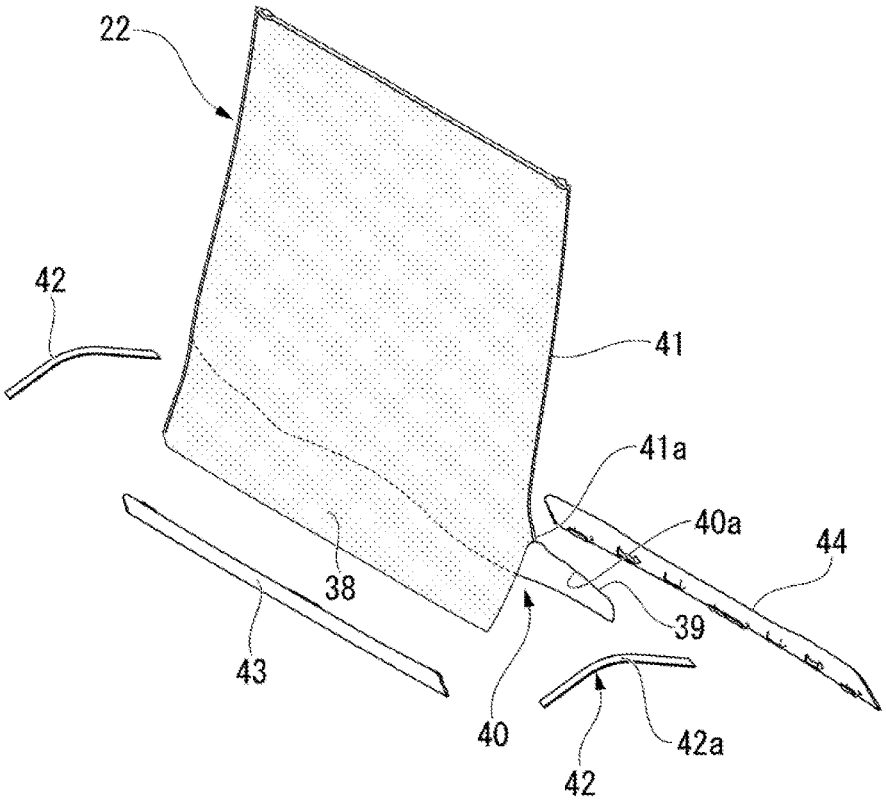
FIG. 17 is an exploded perspective view of an extension material and a member provided in the extension material.

As shown in FIG. 17, in the extension material 22, a front extension material 38 which is disposed on the front surface side (load receiving surface side) of the chair 1 and has an approximately rectangular shape and a rear extension material 39 which is disposed on the rear surface side (a side opposite to the load receiving surface) of the chair 1 and has an approximately rectangular shape are formed in a bag shape. For example, the extension material 22 is formed of acrylic or wool (including mixtures thereof), polyester, or the like, and as shown in FIGS. 1 and 2, the extension material 22 covers the pair of rod members 19 and 19. As shown in FIG. 13, in the front extension material 38 and the rear extension material 39, the upper end edges (one end edge) in the length direction of the rod member 19 and both side end edges in the width direction thereof are stitched to be joined to each other, and an opening portion 40 which is continuous in the width direction is formed on the lower end edge side (the other end edge side) in the length direction.

As shown in FIG. 17, in the extension material 22, an end portion 41*a* on the lower end edge side of the joining portion 41 in the both side end edges of the front extension material 38 and the rear extension material 39 is positioned to be closer to the upper end edge of the side end edge than the lower end edge of the side end edge. Accordingly, the opening portion 40 is formed to have the side opening 40*a* which is opened to the lower end edge sides of both side end edges of the extension material 22.

As shown in FIGS. 13 and 17, a connection plate 42 which connects the lower end edge side of the front extension material 38 and the lower end edge side of the rear extension material 39 forming the side opening 40*a* to each other is provided in the side opening 40*a*. The connection plate 42 is a thin plate which is configured of a resin or the like which is elastically deformed and curved in a L shape at the center portion in the length direction such that the upper end edge side of the extension material 22 protrudes and the lower end edge side is recessed. In the connection plate 42, a first side in a state where the curved portion 42*a* shown in FIG. 17 is interposed therebetween is connected to the lower end edge side of the front extension material 38, and a second side is connected to the lower end edge side of the rear extension material 39.

A curved portion 42*a* is formed in the center portion of the connection plate 42 in the length direction, and the length on the first side is approximately the same as the length on the second side in the state where the curved portion 42*a* is interposed therebetween. Accordingly, the length on the first side of the connection plate 42 is approximately the same as the length of the portion which forms the side opening 40*a* of the front extension material 38, and the length on the second side is approximately the same as the length of the portion which forms the side opening 40*a* of the rear extension material 39. That is, the length on the first side of the connection plate 42 is approximately the same as the length of the front extension material 38 from the end portion 41*a* on the lower end edge side of the joining portion 41 to the lower end edge. In addition, the length on the other end side of the connection plate 42 is approximately the same as the length of the rear extension material 39 from the end portion 41*a* on the lower end edge side of the joining portion 41 to the lower end edge.

For example, the connection between the front extension material 38 or the rear extension material 39 and the connection plate 42 is performed by stitching. Here, for example, the connection of the connection plate 42 to the front extension material 38 or the rear extension material 39 is performed by the following procedure. First, one of the front extension material 38 and the rear extension material 39 is turned over so as to expose the rear surface side. Subsequently, a first side of the connection plate 42 is placed on the extension material in which the rear surface side is exposed, and the connection plate 42 is stitched to the extension material in a state where the extension material is positioned below and the connection plate 42 above, that is, in a state where the connection plate 42 can be viewed. In this case, the end portion of the connection plate 42 on the second side (the side of the other extension material to be stitched) floats. Subsequently, the extension material is inverted, and hereafter, similarly to the case where the one extension material is stitched, the second side of the connection plate 42 is stitched to the rear surface side of the other extension material. Thereafter, as shown in FIG. 16, the portions of the front extension material 38 and the rear extension material 39 which are stitched to the connection plate 42 and form the side opening 40*a* are folded from the outside to the inside along the connection plate 42 and enter the recessed portion 35. Accordingly, it is possible to cause the connection plate 42 to abut the inner surface of the recessed portion 35 to be disposed. That is, by restoring the connection plate 42 curved by the elastic deformation, the connection plate 42 is expanded, and both sides of the connection plate 42 abut the inner surface of the recessed portion 35. Moreover, the connection plate 42 may be molded in a curve shape without being elastically deformed. In this case, when the connection plate 42 enters the recessed portion 35, and the connection plate 42 may be disposed in a state where the connection plate 42 is close to the inner surface of the recessed portion 35 without abutting the inner surface.

Moreover, as shown in FIG. 13, in the opening portion 40 of the extension material 22, a front-side back lining core material 43 is attached to the lower end portion rear surface of the front extension material 38, and a rear-side back lining core material 44 is attached to the lower end portion front surface of the rear extension material 39. Each of the front-side back lining core material 43 and the rear-side back lining core material 44 is formed in a thin plate of a resin or like and is attached to the front extension material 38 or the rear extension material 39 by stitching or the like. A plurality of engagement portions (not shown) are formed on the inner surface (the rear surface) of the front-side back lining core material 43. The engagement portions engage with engagement portions (not shown) formed on the lower support portion 27 of the lower frame portion 24, and the front-side back lining core material 43 is attached and supported to the lower support portion 27. In addition, a plurality of engagement portions (not shown) are formed on the inner surface (the front surface) of the rear-side back lining core material 44. The engagement portions engage with engagement portions (not shown) formed on the lower support portion 27 of the lower frame portion 24, and the rear-side back lining core material 44 is also attached and supported to the lower support portion 27. In this way, the front-side back lining core material 43 and the rear-side back lining core material 44 are attached to the lower support portion 27, and the opening portion 40 of the bag-shaped extension material 22 is closed by the lower frame portion 24 and the opening portion 40 is not exposed.

Moreover, in the extension material 22, excess length portions 45, in which the front extension material 38 and the rear extension material 39 are joined to each other slightly further inside than the outer end in the width direction of the chair 1, are formed on the end edge portion (upper end edge portion) of the upper end edge side (one end edge side) of the extension material 22. In addition, as shown in FIG. 18 which is a sectional view taken along line C-C of FIG. 14B, an exposure opening 46 exposed from the rod member 19 is formed in the inside of the excess length portion 45 in the width direction.

In the rod member 19, a fitting hole 19*a* having an opening which communicates with the exposure opening 46 and a protrusion edge portion 19*b* which protrudes in the length direction of the rod member 19 and abuts the excess length portion 45 are formed on the end portion of the rod member 19 on the exposure opening 46 side, that is, the upper end portion thereof. In the present embodiment, the protrusion edge portion 19*b* is formed in an annular shape in which the outer circumferential portion surrounding the fitting hole 19*a* is continuous in the entire circumference in the circumferential direction. Accordingly, the protrusion edge portion 19*b* abuts not only the excess length portion 45 of the extension material 22 but also the entire circumference on the outer circumferential portion of the exposure opening 46.

In addition, the connection frame 25 is attached to the fitting hole 19*a* of the rod member 19 which is exposed to the exposure opening 46 and communicates with the exposure opening 46. The connection frame 25 is fitted to the fitting hole 19*a* through the exposure opening 46, and includes a closing portion 47 which closes the exposure opening 46 and a connection portion 48 which connects the pair of closing portions 47 and 47 to each other as shown in FIG. 13. The pair of closing portions 47 and 47 is attached to the corresponding rod members 19, and the pair of rod members 19 and 19 is connected to each other.

Figure 18:
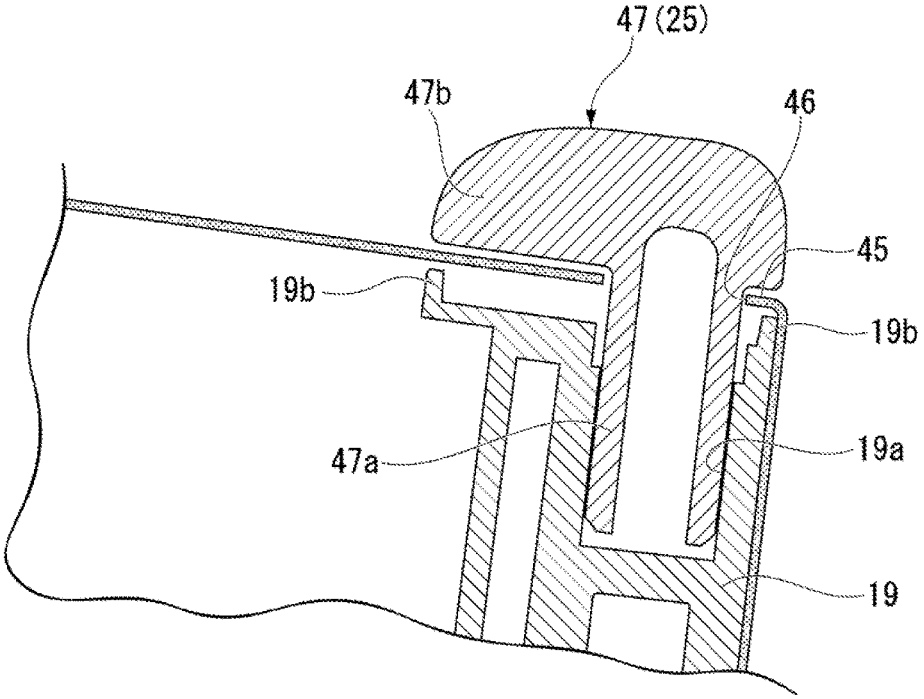
FIG. 18 is a sectional view taken along line C-C of FIG. 14B.

As shown in FIG. 18, the closing portion 47 includes a fitting protrusion 47*a* which is fitted to the fitting hole 19*a* through the exposure opening 46 and a cover portion 47*b* which positioned on the root side (upper end side) of the fitting protrusion 47*a* and expands outside the fitting protrusion 47*a*. The cover portion 47*b* abuts the protrusion edge portion 19*b* of the rod member 19 via the outer circumferential portion of the exposure opening 46 including the excess length portion 45 of the extension material 22 in a state where the fitting protrusion 47*a* is fitted into the fitting hole 19*a*. The fitting protrusion 47*a* is formed in a tubular shape having a hole portion in the inner portion, and a nut is accommodated in the hole portion as described later.

Figure 19:
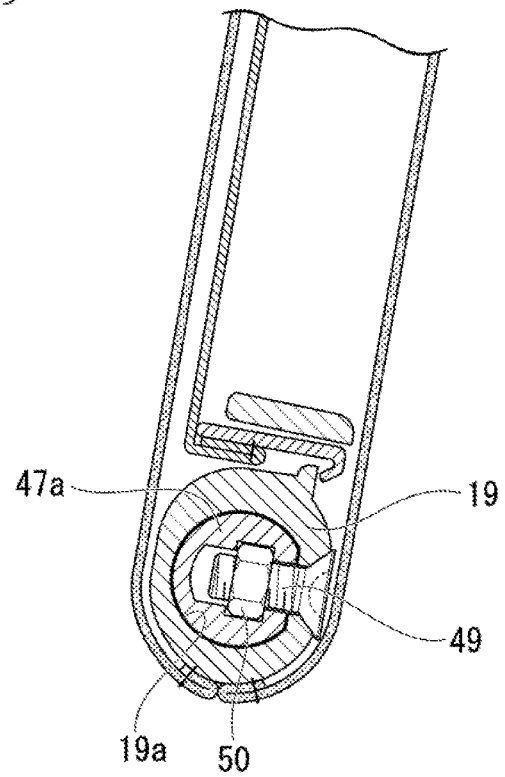
FIG. 19 is a sectional view taken along line D-D of FIG. 14B.

As shown in FIG. 19 which is a sectional view taken along line D-D of FIG. 14B, the closing portion 47 is fixed to the rod member 19 (fitting hole 19*a*) by a screw 49 which is inserted from the rear side (rear surface side) of the rod member 19. That is, the screw 49 is inserted into the fitting hole 19*a* through a screw hole (not shown) which is formed on the rear side (rear surface side) of the rod member 19. In addition, the screw 49 is further inserted into the fitting protrusion 47*a* fitted into the fitting hole 19*a* and is screwed to the nut 50 accommodated in the hole portion.

Accordingly, the fitting protrusion 47*a* is screwed into the fitting hole 19*a* of the rod member 19 to be fixed thereto.

In addition, the attachment between the connection frame 25 and the pair of rod members 19 and 19 of the extension material 22 including the above-described screwing is performed as follows.

First, as shown in FIG. 13, with respect to the bag-shaped extension material 22, each connection plate 42 is attached to each side opening 40*a*, the front-side back lining core material 43 is attached to the front extension material 38, and the rear-side back lining core material 44 is attached to the rear extension material 39. However, the attachment of the front-side back lining core material 43 or the rear-side back lining core material 44 may be performed later.

Subsequently, the fitting protrusions 47*a* of the closing portions 47 of the connection frame 25 are inserted into the exposure openings 46 and 46 on the upper end edge of the extension material 22 from above, and the fitting protrusions 47*a* protrude toward the inside of the extension material 22 from the exposure openings 46 and 46. Subsequently, the extension material 22 is turned over in a state where the fitting protrusions 47*a* protrude from the exposure openings 46 and 46. That is, the turned-over extension material 22 is pulled upward in a state where the fitting protrusions 47*a* are positioned on the lower sides, the connection portion 48 of the connection frame 25 is accommodated into the turned-over extension material 22, and the fitting protrusions 47*a* are exposed in a state of protruding toward the lower end side.

Subsequently, the pair of fitting protrusions 47*a* protruding toward the lower end side is fitted into the fitting hole 19*a* of the corresponding rod members 19, and continuously, as shown in FIG. 19, the fitting protrusion 47*a* is screwed to the rod member 19. In addition, before the fitting protrusion 47*a* is fitted into the fitting hole 19*a* of the rod member 19, the surface material 21 may be attached to the frame member 20. As shown in FIG. 18, when the fitting protrusion 47*a* is fitted into the fitting hole 19*a* of the rod member 19, the fitting protrusion 47*a* is fitted into the fitting hole 19*a* of the rod member through the exposure opening 46 of the extension material 22, and the cover portion 47*b* abuts the entire circumference of the outer circumferential portion of the exposure opening 46 and abuts the protrusion edge portion 19*b* of the rod member 19 via the excess length portion 45 or the like. Accordingly, the excess length portion 45 of the extension material 22 is positioned to the protrusion edge portion 19*b* of the rod member 19. Accordingly, in a case where the extension material 22 is largely extended, positional deviation between the exposure opening 46 and the rod member 19 decreases.

In this way, if the fitting protrusions 47*a* are screwed and the connection frame 25 is attached to the pair of rod members 19 and 19 to be fixed, the turned-over extension material 22 is returned to the original state to cover the pair of rod members 19 and 19.

In this case, since the opening portion 40 of the extension material 22 has the side openings 40*a*, it is possible to largely expand the opening of the bag-shaped extension material 22, and the frame member 20 can be easily covered with the extension material 22. In this way, the turned-over extension material 22 is returned to the original state, and the rod members 19 and 19 (frame member 20) are covered with the one end side (upper end side) of the bag-shaped extension material 22 in the length direction through the opening portion 40. Accordingly, the screw 49 which fixes the fitting protrusion 47*a* is hidden from the extension material 22 without being exposed.

In this way, if the frame member 20 is covered with the extension material 22, as shown in FIG. 16, the connection plate 42 attached to the side opening 40*a* of the extension material 22 is pressed into the recessed portion 35 of the frame member 20. Accordingly, the portion connected to the connection plate 42 which forms the side opening 40*a* of each of the front extension material 38 and the rear extension material 39 is also accommodated in the recessed portion 35. Therefore, the armrest 6 is attached to the recessed portion 35, and the side opening 40*a* of the extension material 22 or the connection plate 42 is hidden without being exposed.

In addition, the front-side back lining core material 43 and the rear-side back lining core material 44 attached to the opening portion 40 of the extension material 22 are also attached to the lower support portion 27. Accordingly, the extension material 22 is fixed to the frame member 20.

In the present embodiment, in the extension material 22 which is fixed in this way, a load (body weight) which is applied by a back portion of a seated person, that is, a repulsive force with respect to a load in the surface perpendicular direction is set to be relatively smaller than the same repulsive force of the surface material 21. That is, in the present embodiment, the surface material 21 attached to the frame member 20 which is a strength member becomes a repulsive body (elastic resistance body) which repels the load (body weight) applied by the back portion of the seated person. Accordingly, since the repulsive force is not limited with respect to materials or design of the front extension material 38 and the rear extension material 39 configuring the extension material 22, the material or the design is freely selected based on the desired characteristics or the like. That is, a high degree of freedom in terms of design or the like is obtained.

In the backrest 5 (the load support member for a chair) having the above-described configuration, an attachment portion 51 of the lower frame portion 24 shown in FIG. 13 is attached to the support base 3 shown in FIGS. 1 and 2, and the chair 1 is assembled. Moreover, the backrest 5 is attached to the support base 3 in this way, and the front-side back lining core material 43 or the rear-side back lining core material 44 attached to the opening portion 40 of the extension material 22 is accommodated in the extension material 22 without being exposed.

In the load support member (backrest 5) of a chair of the present embodiment, separately from the extension material 22 covering the frame member 20, since the surface material 21 having a repulsive force with respect to the load in the surface perpendicular direction is bridged between the rod members 19 and 19, for example, it is possible to appropriately select the material or the like of the extension material 22 by setting the strength of the surface material 21 to a degree by which the load of the seated person can be supported. Accordingly, it is possible to greatly increase the degree of freedom in terms of design. In addition, since the extension material 22 is supported to the frame member 20 so as to be wound around the rod member 19 by the own shape and tension, a dedicated support portion is not required, and it is possible to mold the frame member 20 at a low cost without complicating the shape of the rod member 19. In addition, since the side support portion 26 which is formed on the inner surface of the rod member 19 is hidden by the extension material 22, it is possible to prevent an appearance from deteriorating due to the side support portion 26.

In addition, the side support portion 26 is the fitting recessed portion 29 which is formed on the inner surface of each rod member 19, when the shape of the rod member 19 having the fitting recessed portion 29 is manufactured, it is possible to easily mold the rod member 19 by performing molding in a state where two molds are arranged in the surface perpendicular direction of the load receiving surface. Accordingly, it is possible to mold the frame member 20 at a lower cost.

In addition, the end portion of the support material 28 on the load receiving surface side is positioned to be closer to the side opposite to the load receiving surface side than the end portion on the load receiving surface side of the portion of the rod member 19 in which the fitting recessed portion 29 is formed, the position of the surface material 21 is further retreated (offset) to the rear surface side of the chair 1 than the end portion on load receiving surface side of the rod member 19. Accordingly, since the surface material 21 abut the front extension material 38 of the extension material 22 from the rear side, deformation of the extension material 22 is prevented, and a more favorable appearance can be obtained.

Moreover, since the repulsive force of the bag-shaped extension material 22 is smaller than the repulsive force of the surface material 21, the extension material 22 is relatively softer than the surface material 21 (the elastic resistance force is smaller), and even when a load is applied to the extension material 22 due to a body weight of the seated person or the like, a friction resistance is not easily generated between the extension material 22 and the rod member 19.

Moreover, since the extension material 22 is soft, the extension material 22 is in contact with the rod member 19 without coming into close contact with the rod member 19. Accordingly, even when the load in the surface perpendicular direction is applied to the extension material 22, the extension material does not interfere with the rod member 19, and occurrence of frictional noise is prevented or decreased. In addition, a force which supports a seated person' body is secured by the relatively hard surface material 21. However, since the surface material 21 is bridged between the facing surfaces of the rod members 19, the surface material 21 does not interfere with the bar-shaped extension material 22.

Since the chair 1 according to the present embodiment includes the backrest 5 having a high degree of freedom in terms of design, it is possible to greatly increase a degree of freedom in terms of design of the chair 1. In addition, since it is possible to form the frame member 20 at a low cost without complicating the shape of the rod member 19, it is possible to reduce the cost of the chair 1.

Next, another embodiment of the load support member for a chair according to the present invention will be described.

Figure 20:
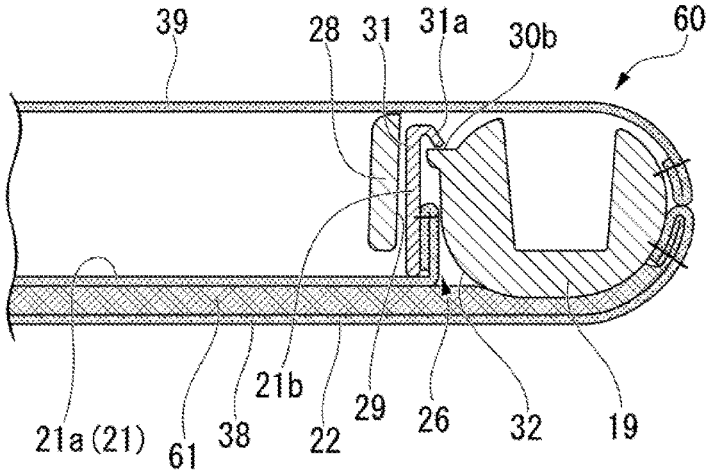
FIG. 20 is a sectional view of a main portion of a backrest according to another embodiment of the load support member for a chair of the present invention.

FIG. 20 is a sectional view of a main portion of a backrest 60 which is the load support member for a chair according to the present invention, that is, a cross sectional view (sectional view taken along line A-A of FIG. 14A) corresponding to FIG. 15 in the above-described embodiment.

As shown in FIG. 20, the backrest 60 of the present embodiment is different from the backrest 5 of the above-described embodiment in that a spacer surface material 61 is disposed between the front extension material 38 and the surface material (interior material) 21. For example, the spacer surface material 61 is formed of non-woven fabric, elastomer, or the like, and the spacer surface material 61 is formed such that a repulsive force of the spacer surface material with respect to the load (body weight) applied by the back portion of the seated person, that is, the load in the surface perpendicular direction is relatively smaller than a repulsive force of the surface material main body 21*a* in the surface material 21. In addition, the repulsive force of the spacer surface material 61 may be relatively larger or smaller than, or the same as the repulsive force of the front extension material 38.

The spacer surface material 61 is formed in a rectangular shape which has the same shape and size as those of the front extension material 38 shown in FIG. 13 or 17, the four side, that is, the upper end edge portion, both end edge portions, and the lower end edge portion are stitched to the front extension material 38, and the spacer surface material 61 is integrally attached to the front extension material 38. That is, in both end edge portions of the front extension material 38 as shown in FIG. 20, each side end edge portion of the spacer surface material 61 is folded along with each side end edge portion of the front extension material 38 and is stitched in this state, and the spacer surface material 61 is integrally attached to the front extension material 38.

In addition, similarly to the both end edge portions, the upper end edge portion and the lower end edge portion of the spacer surface material 61 are integrally attached to the upper end edge portion or the lower end edge portion of the front extension material 38. In addition, the respective end edge portions and the upper end edge portion of the front extension material 38 to which the spacer surface material 61 is integrally attached and the respective end edge portions and the upper end edge portion of the rear extension material 39 similarly folded and stitched are stitched so as to be integrated to each other, and the extension material 22 to which the spacer surface material 61 is integrally attached is formed.

Similarly to the above-described embodiment, the extension material 22 having the spacer surface material 61 formed in this way covers the frame member 20. That is, the extension material 22 covers the frame member 20 from the upper end side of the frame member 20 through the opening portion 40 shown in FIG. 13 so as to be attached to the frame member 20.

In addition to effects similar to those of the backrest 5 of the above-described embodiment, the load support member (backrest 60) for a chair of the present embodiment has the following effects.

That is, since the spacer surface material 61 having a smaller repulsive force than that of the surface material 21 (surface material main body 21*a*) is disposed between the front extension material 38 and the surface material 21, when a body weight of a seated person is applied to the backrest 60 via the front extension material 38, the backrest 60 supports the body weight of the seated person by the surface material 21 in a state where bending of the spacer surface material 61 is added to bending of the front extension material 38. Accordingly, a seated person further feels softness at the time of the seating as the bending of the spacer surface material 61 is added, more improved seating feeling is obtained. In addition, since the spacer surface material 61 is interposed, the upper edge portion of the extension material 22 and the upper edge portion of the surface material 21 do not easily directly abut each other, and even when the chair is continuously used over a long period, it is possible to prevent the upper edge portion of the surface material 21 from extending.

In addition, since covering of the spacer surface material 61 is continuously applied from the surface side of the surface material 21 to the front surface side of the rod member 19, the spacer surface material 61 fills a portion between the surface material 21 and the rod member 19, and there is almost no influence of a bump therebetween. Accordingly, there is no possibility that a bump will discomfort the back of a seated person.

In addition, since the spacer surface material 61 is integrally attached to the rear surface of the front extension material 38 in advance, it is possible to easily perform an assembly process of covering the frame member 20 with the extension material 22 so as to assemble the backrest 60.

In addition, the present invention is not limited to the above-described embodiment and various modifications can be applied within a scope which does not depart from the gist of the present invention.

For example, in the above-described embodiment, the repulsive force of the bag-shaped extension material 22 is smaller than the repulsive force of the surface material 21. However, the repulsive force of the extension material 22 may be the same as the repulsive force of the surface material 21 or may be larger than the repulsive force of the surface material 21.

In addition, in the above-described embodiment, the lower end portion of the front extension material 38 and the lower end portion of the rear extension material 39 are attached to the lower frame portion 24 via the front-side back lining core material 43 or the rear-side back lining core material 44. With respect to the attachment of the lower end portion of the front extension material 38 or the lower end portion of the rear extension material 39 to the lower frame portion 24, an appropriate member other than the front-side back lining core material 43 or the rear-side back lining core material 44 may be used.

In addition, as the surface material 21 (interior material), for example, the surface material main body may have a shape in which slits are formed without forming a uniform surface in which the surface material main body 21*a* is continuous as shown in FIG. 13. Specifically, a plurality of (for example, two to five) long slits in the right-left direction are formed at approximately equal intervals in the up-down direction, and a portion between the slits may be formed in a band shape. It is possible to increase flexibility of the surface material (interior material) by forming the slits. In addition, in the case where the slits are formed, for example, the surface material main body can be formed of nylon, a resin (elastomer) such as polypropylene, or the like. Moreover, the side portion support frame 21*b* or the lower portion support frame 21*c* configuring the surface material (interior material) may be integrally formed with the surface material main body by bending the end portions of the surface material main body.

INDUSTRIAL APPLICABILITY

According to the present invention, the gap generated by the operation member and the adjacent member is closed by the shielding portion when the operation member has the operation posture, it is possible to prevent a user's finger from being interposed between the operation member and the adjacent member, and it is possible to prevent discomforting the user.

Moreover, according to the load support member for a chair of the present invention, it is possible to support the exterior material and the interior material by the frame member without complicating the shape of the frame member, and it is possible to increase a degree of freedom in terms of design.

Moreover, according to the chair of the present invention, it is possible to greatly increase the degree of freedom in terms of design, and it is possible to mold the frame member at a low cost without complicating the shape of the rod member.

REFERENCE SIGNS LIST

1: chair
2: leg portion
3: support base
4: seat (seat body)
5, 60: backrest (load support member for a chair)
6: armrest
7: operating unit
7*a*: holder
7*a*1: base portion
7*a*2: bearing portion
7*a*3: accommodation groove
7*a*4: wave-shaped portion
7*a*5: flange
7*b*: raising/lowering operation member (operation member)
7*b*1: pivot
7*b*2: operation plate
7*b*3: connection portion
7*b*4: protrusion portion
7*b*5: shielding piece (shielding portion)
7*b*51: front end
7*b*52: maximum protrusion portion
7*b*53: curved side
7*b*54: inclined side
7*b*6: tip
7*b*7: recess
7*c*: locking adjustment operation member (second operation member)
7*c*1: body
7*c*2: lever
7*c*3: knock mechanism
7*c*31: spring
7*c*32: tip portion
7*d*: cover
19: rod member
20: frame member
21: surface material (interior material)
22: extension material (exterior material)
26: side support portion (support portion)
28: support material
29: fitting recessed portion
38: front extension material
39: rear extension material
61: spacer surface material

The invention claimed is:

1. A load support member for a chair which is included in a chair, comprising:

a frame member which is a strength member which includes a pair of rod members which is separated from each other in a width direction of the chair and is disposed to be approximately parallel to each other; and an exterior material which includes a front extension material disposed on a load receiving surface side of the chair and a rear extension material disposed on a side opposite to the load receiving surface which are joined to each other on one end edge in a length direction of the rod member and both end edges in the width direction, the exterior material being formed in a bag shape having an opening portion continuous in the width direction on the other end edge side in the length direction and covering the frame member through the opening portion from one end side in the length direction of the frame member, wherein a support portion is provided on each of inner surfaces facing each other of the pair of rod members, and wherein an interior material having a repulsive force with respect to a load in a surface perpendicular direction is bridged between the pair of rod members by being supported by the support portion, the interior material being disposed between the front extension material and the rear extension material, wherein a spacer surface material is disposed between the front extension material and the interior material, and wherein a repulsive force of the spacer surface material with respect to the load in the surface perpendicular direction is relatively smaller than the repulsive force of the interior material with respect to the load in the surface perpendicular direction.

2. The load support member of a chair according to claim 1, wherein the support portion includes a fitting recessed portion which is opened to the load receiving surface side.

3. The load support member of a chair according to claim 2, wherein the support portion is configured of a support material which is disposed with a gap with respect to the rod member on the inner surface side of the rod member, and the gap between the rod member and the support material becomes the fitting recessed portion, and wherein the support material has a first end portion disposed on the load receiving surface side, a portion of the rod member, which forms the fitting recessed portion, has a second end portion disposed on the load receiving surface side, and the first end portion is positioned to be further from the load receiving surface side than the second end portion.

4. The load support member of a chair according to claim 1, wherein a repulsive force of the exterior material with respect to the load in the surface perpendicular direction is relatively smaller than the repulsive force of the interior material with respect to the load in the surface perpendicular direction.

5. The load support member of a chair according to claim 1, wherein covering of the spacer surface material is continuously applied from a front surface side of the interior material to a front surface side of the rod member.

6. The load support member of a chair according to claim 1, wherein the spacer surface material is integrally attached to a rear surface of the front extension material.

7. A chair comprising the load support member for a chair according to claim 1 as a backrest in which the rod member is disposed in an up-down direction and the opening portion is disposed on a lower end portion.

8. The load support member of a chair according to claim 3, wherein a repulsive force of the exterior material with respect to the load in the surface perpendicular direction is relatively smaller than the repulsive force of the interior material with respect to the load in the surface perpendicular direction.

9. The load support member of a chair according to claim 5, wherein the spacer surface material is integrally attached to a rear surface of the front extension material.

10. A chair comprising the load support member for a chair according to 6 as a backrest in which the rod member is disposed in an up-down direction and the opening portion is disposed on a lower end portion.

* * * * *